US006282390B1

(12) United States Patent
Miyabe et al.

(10) Patent No.: US 6,282,390 B1
(45) Date of Patent: Aug. 28, 2001

(54) PROCESS CARTRIDGE AND ELECTROPHOTOGRAPHIC IMAGE FORMING APPARATUS

(75) Inventors: Shigeo Miyabe, Numazu; Jun Miyamoto, Mishima; Takeshi Arimitsu, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,086

(22) Filed: Oct. 26, 1999

(30) Foreign Application Priority Data

Oct. 26, 1998 (JP) ..... 10-321301

(51) Int. Cl.[7] ..... G03G 21/16
(52) U.S. Cl. ..... 399/111
(58) Field of Search ..... 399/110, 111, 399/113, 116, 117

(56) References Cited

U.S. PATENT DOCUMENTS

| | | | | |
|---|---|---|---|---|
| 5,136,333 | * | 8/1992 | Craft et al. | 399/111 |
| 5,331,373 | | 7/1994 | Nomura et al. . | |
| 5,452,056 | | 9/1995 | Nomura et al. . | |
| 5,463,446 | | 10/1995 | Watanabe et al. . | |
| 5,585,895 | | 12/1996 | Yashiro et al. . | |
| 5,640,650 | | 6/1997 | Watanabe et al. | 399/117 |
| 5,839,028 | | 11/1998 | Nomura et al. | 399/109 |
| 5,873,012 | | 2/1999 | Miyabe et al. | 399/90 |
| 5,878,309 | | 3/1999 | Nomura et al. | 399/111 |
| 5,878,310 | | 3/1999 | Noda et al. | 399/17 |
| 5,926,666 | | 7/1999 | Miura et al. | 399/25 |
| 5,943,529 | | 8/1999 | Miyabe et al. | 399/111 |
| 5,946,531 | | 8/1999 | Miura et al. | 399/111 |
| 5,950,047 | | 9/1999 | Miyabe et al. | 399/111 |
| 5,966,567 | | 10/1999 | Miatsuzaki et al. | 399/111 |
| 6,002,896 | | 12/1999 | Miyamoto et al. | 399/114 |
| 6,088,555 | * | 7/2000 | Mizuno | 399/113 |
| 6,115,569 | * | 9/2000 | Akutsu | 399/111 |

FOREIGN PATENT DOCUMENTS 60-149669 8/1985 (JP) .

* cited by examiner

*Primary Examiner*—Robert Beatty
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive member; a process device actable on the electrophotographic photosensitive member; and a frame for supporting at least the electrophotographic photosensitive member. The frame includes a first positioning portion and a second positioning portion for positioning the process cartridge relative to the main assembly of the electrophotographic image forming apparatus coaxially with the electrophotographic photosensitive member. The first and second positioning portions are each provided with at least three receiving portions at three positions on an outer surface. Each of the receiving portions of each of the first positioning portion and the second positioning portion positions the first and second positioning portions by contacting a first positioning member of the main assembly of the electrophotographic image forming apparatus and a first positioning portion of a mounting device when the process cartridge is mounted to the main assembly of the electrophotographic image forming apparatus while being supported by a movable mounting device of the main assembly of the electrophotographic image forming apparatus.

7 Claims, 18 Drawing Sheets

(a)

(b)

(a)

(b)

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus.

In this specification, the term "electrophotographic image forming apparatus" refers to an apparatus that forms an image on a recording medium with the use of an electrophotographic image formation process. Examples of an electrophotographic image forming apparatus include an electrophotographic copying machine, an electrophotographic printer (for examples, a laser beam printer, an LED printer, or the like), a facsimile apparatus, a word processor, and the like.

The term "process cartridge" refers to a cartridge that is removably installable in the main assembly of an image forming apparatus, and in which a charging means or cleaning means are integrally disposed along with an electrophotographic photosensitive member, or in which at least one of a charging means and a cleaning means is integrally disposed along with an electrophotographic photosensitive member.

In the past, an electrophotographic image forming apparatus which employed an electrophotographic image formation process employed a process cartridge system, according to which an electrophotographic photosensitive member, and a processing means which worked on an electrophotographic photosensitive member, were integrated in the form of a cartridge which was removably installable in the main assembly of the image forming apparatus. Also according to this process cartridge system, an electrophotographic image forming apparatus could be maintained by the users themselves, without relying on service personnel. Therefore, the operational efficiency could be remarkably improved. Thus, a process cartridge system has been widely used in the field of an electrophotographic image forming apparatus.

In the case of a process cartridge system such as the one described above, the electrophotographic photosensitive member is supported on a frame, which in turn is mounted to the main assembly of the image forming apparatus, by which the photosensitive member is correctly positioned.

SUMMARY OF THE INVENTION

The present invention is a result of the further advancement of the above described conventional technologies.

The primary object of the present invention is to provide a process cartridge wherein an electrophotographic photosensitive member can be supported at the correct position in the main assembly of the image forming apparatus.

It is another object of the present invention to provide an electrophotographic image forming apparatus wherein an electrophotographic photosensitive member can be supported at the correct position in the main assembly of the image forming apparatus.

According to an aspect of the present invention, there is provided a process cartridge detachably mountable to a main assembly of an electrophotographic image forming apparatus, comprising: an electrophotographic photosensitive member; process means actable on the electrophotographic photosensitive member; a frame for supporting at least the electrophotographic photosensitive member; wherein the frame includes a first positioning portion and a second positioning portion for positioning the process cartridge relative to the main assembly of the electrophotographic image forming apparatus coaxially with the electrophotographic photosensitive member; wherein the first and second positioning portions are each provided with at least three receiving portions at three positions on an outer surface; wherein each of the receiving portions of each of the first positioning portion and the second positioning portion positions the first and second positioning portions by contacting a first positioning member of the main assembly of the electrophotographic image forming apparatus and a second positioning portion of the mounting means when the process cartridge is mounted to the main assembly of the electrophotographic image forming apparatus while being supported by a movable mounting means of the main assembly of the electrophotographic image forming apparatus.

DESCRIPTION OF THE PREFERRED EMBODIMENTS

Hereinafter, the embodiments of the present invention will be described in detail with reference to the appended drawings.

In the following description of the embodiments of the present invention, the direction parallel to the shorter edges of a process cartridge B coincides with the direction in which the process cartridge B is installed into, or removed from, the main assembly A1 of an electrophotographic image forming apparatus, as well as the direction in which a recording medium S is conveyed. The longitudinal direction of the process cartridge B means the direction perpendicular (substantially perpendicular) to the direction in which the process cartridge B is installed into, or removed from, the electrophotographic image forming apparatus main assembly A1. The left or right side of the process cartridge B means the left or right side of the recording medium S as seen from above, and upstream in terms of the conveyance direction of the recording medium S.

(General Structure of Electrophotographic Image Forming Apparatus)

Figure 1:
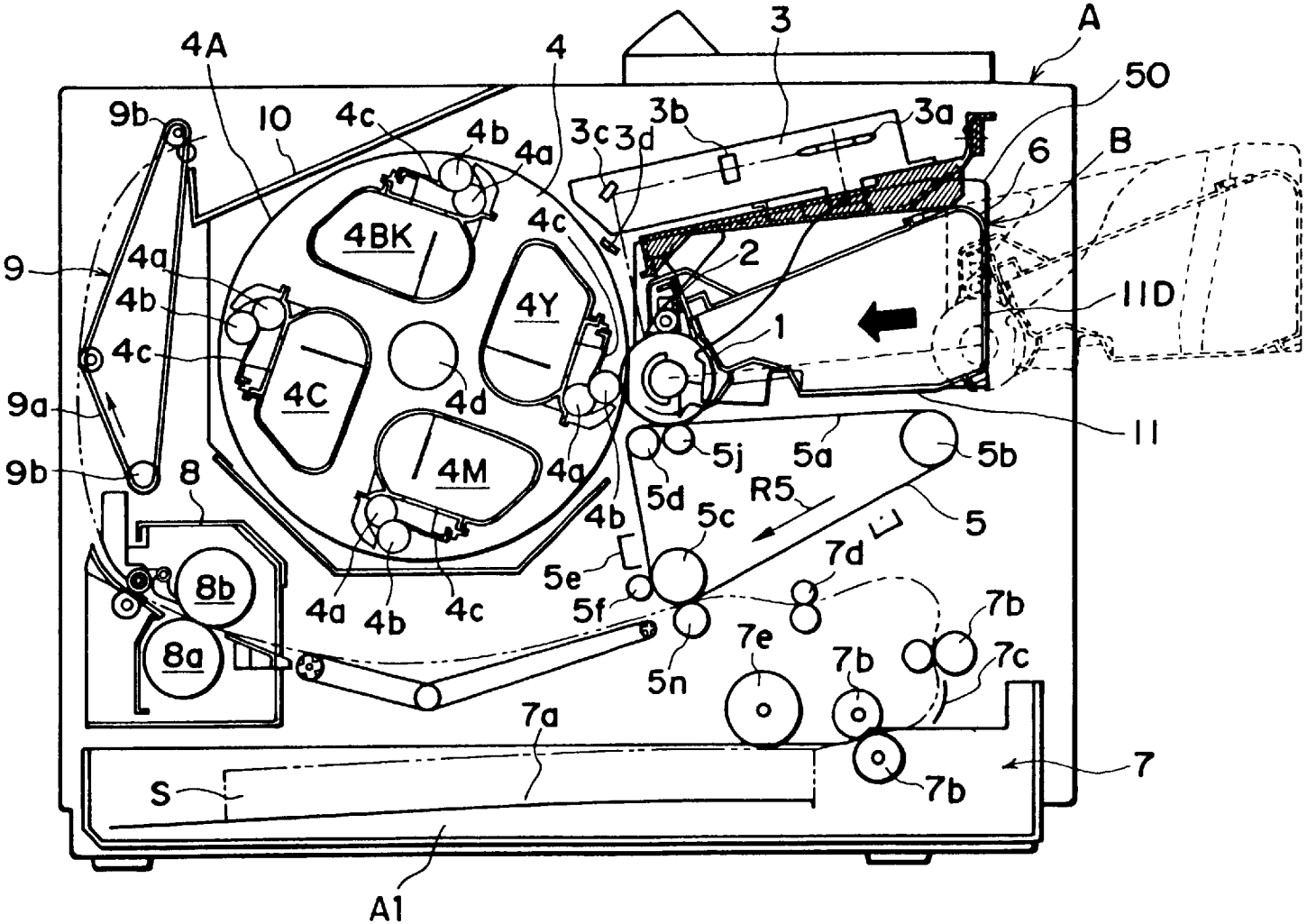
FIG. 1 is a vertical sectional view of an electrophotographic image forming apparatus in accordance with the present invention.

FIG. 1 is a vertical sectional view of an electrophotographic image forming apparatus (hereinafter, "image forming apparatus") in accordance with the present invention, and depicts the general structure of the entire apparatus.

First, referring to FIG. 1, the general structure of the entirety of the image forming apparatus A will be described. The image forming apparatus A illustrated in the drawing is a full-color laser beam printer based on four primary colors.

The image forming apparatus A in the drawing is provided with an electrophotographic photosensitive member 1 (hereinafter, "photosensitive drum") in the form of a drum The photosensitive drum 1 is rotationally driven in the counterclockwise direction in the drawing by a driving means, which will be described later. Along the peripheral surface of the photosensitive drum 1, a charging apparatus 2 (charging means), an exposing apparatus 3, a developing apparatus (developing means) 4, a transferring apparatus (transfer means) 5, a cleaning apparatus 6 (cleaning means). and the like, are disposed in the listed order in terms of the rotational direction of the photosensitive drum 1. The charging apparatus 2 is an apparatus for uniformly charging the peripheral surface of the photosensitive drum 1. The exposing apparatus 3 is an apparatus for forming an electrostatic latent image on the photosensitive drum 1 by projecting a laser beam modulated with image formation data. The developing apparatus 4 is an apparatus for developing the latent image formed on the photosensitive drum 1 into a toner image by adhering toner (developer) to the electrostatic latent image formed on the photosensitive drum 1 The transferring apparatus 5 is an apparatus for transferring (primary transfer) the toner image formed on the photosensitive drum 1 The cleaning apparatus 6 is an apparatus for removing the transfer residual toner, i.e., the toner which remains on the peripheral surface of the photosensitive drum 1 after the primary transfer.

The photosensitive drum 1, charging apparatus, and cleaning apparatus 6 for removing the residual toner, are integrated in the form of a process cartridge B, which is removably installable in the main assembly A1 (hereinafter, apparatus main assembly) of the image forming apparatus A.

In addition to the above described apparatuses, the electrophotographic image forming apparatus A comprises a conveying apparatus 7 (conveying means) for conveying recording medium S such as recording paper, OHP sheet, fabric, or the like, to the transferring apparatus 5. The electrophotographic image forming apparatus A also comprises a fixing apparatus 8 for fixing the toner image to the recording medium S after the secondary transfer, i.e., the transfer of the toner image onto the recording medium S by the transferring apparatus 5.

Next, the structure of each of the above described portions of the laser beam printer will be described.

(Photosensitive Drum)

Figure 3:
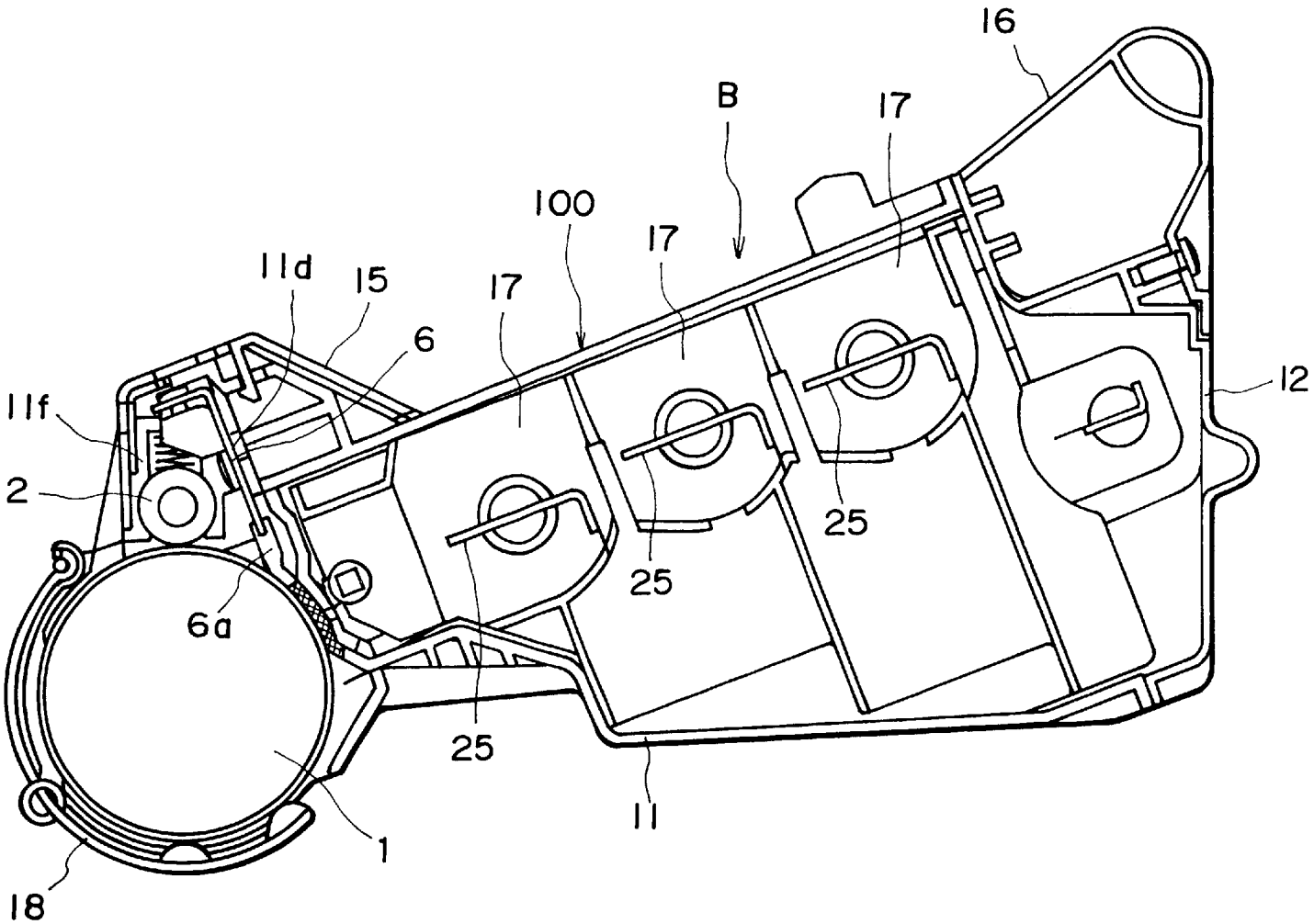
FIG. 3 is a vertical sectional view of a process cartridge in accordance with the present invention.
Figure 4:
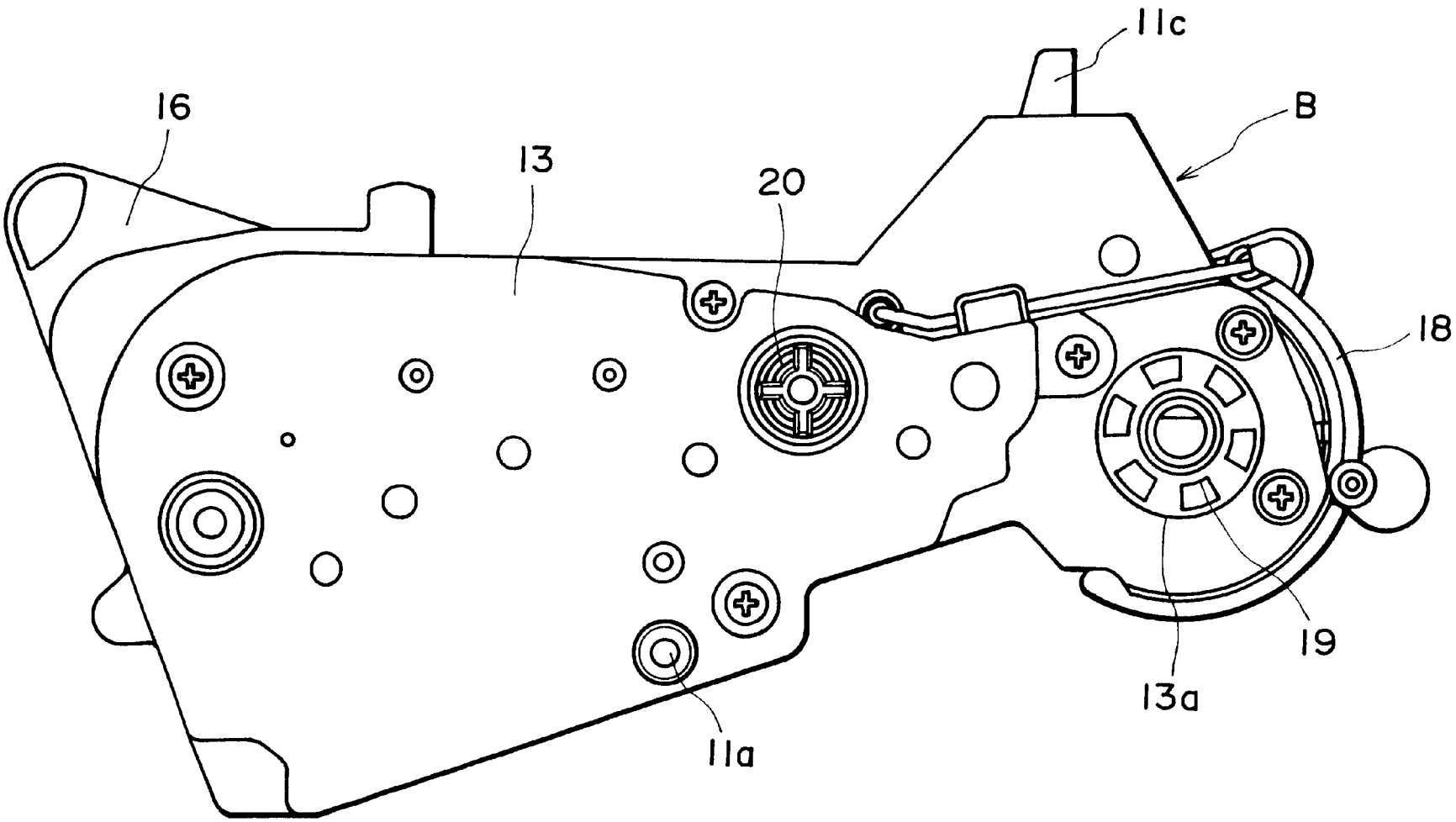
FIG. 4 is a right side view of the process cartridge.
Figure 17:
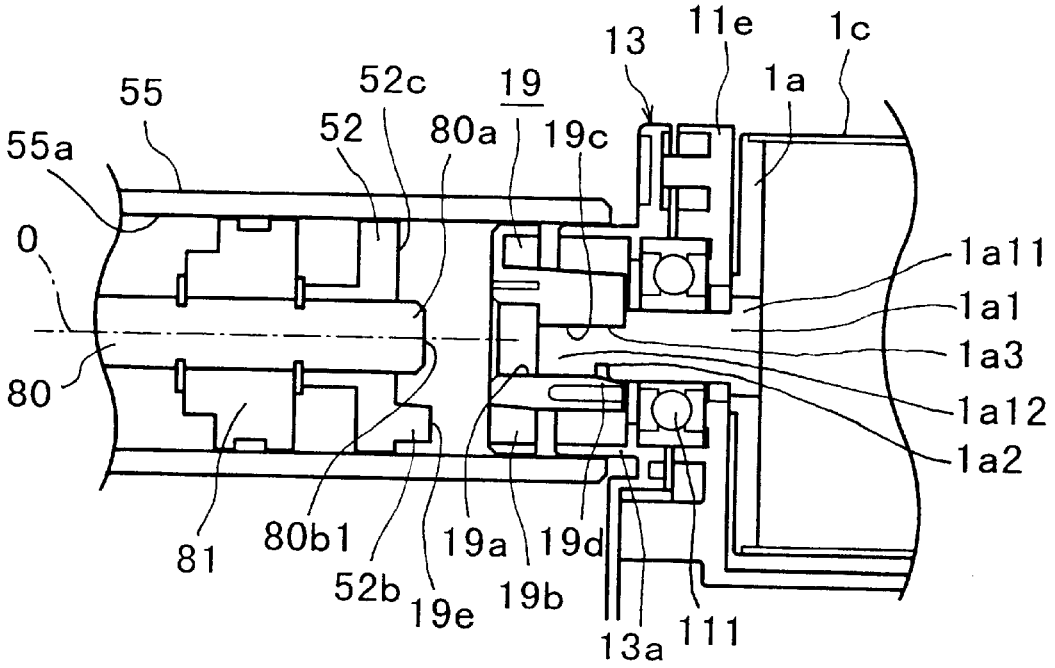
FIG. 17 is a horizontal sectional view of the drum driving force transmission junction between the main assembly of an electrophotographic image forming apparatus and a process cartridge, and its adjacencies.
Figure 17:
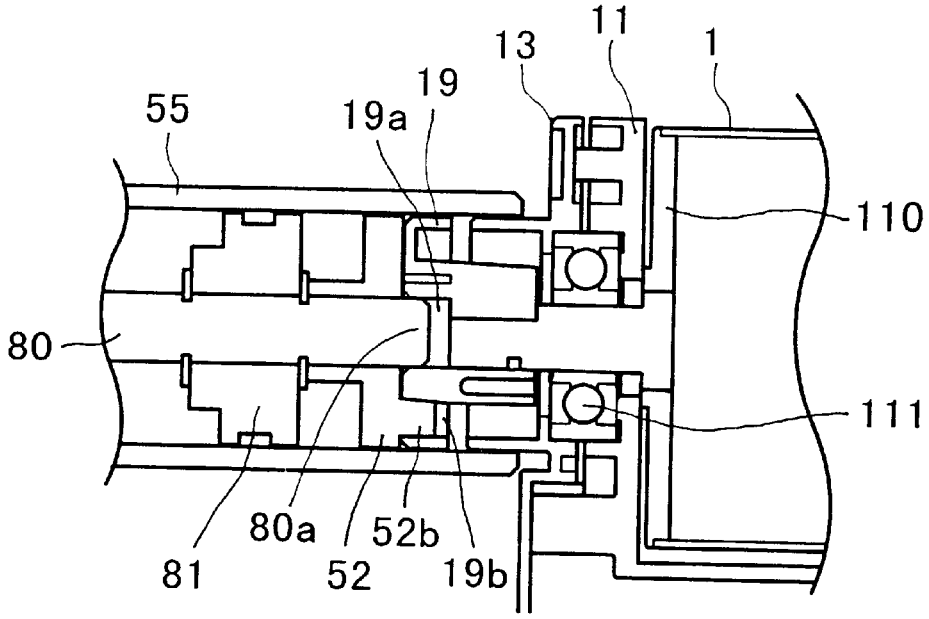

The photosensitive drum 1 comprises an aluminum cylinder 1*c* with a diameter of 47 mm (FIG. 17(*a*)), and an organic photoconductive layer (OPC) coated on the peripheral surface of the aluminum cylinder 1*c*. The photosensitive drum 1 is rotationally supported at both longitudinal ends by the frame 100 of the process cartridge B, which will be described later (FIG. 3). The photosensitive drum 1 is rotationally driven in the direction indicated by an arrow mark as a driving force is transmitted from a driving motor (unillustrated) in the apparatus main assembly A1 to one of the longitudinal ends of the photosensitive drum 1.

(Charging Apparatus)

As for the charging apparatus 2, a so-called contact type charging apparatus such as the one disclosed in Japanese Patent Laid-Open Application No. 149,669/1985 can be employed. A charging member is an electrically conductive roller (C roller). The peripheral surface of the photosensitive drum 1 is uniformly charged by placing the charge roller in contact with the peripheral surface of the photosensitive drum 1 and applying charge bias voltage to the charging roller from a power source (unillustrated).

(Exposing Apparatus)

The exposing apparatus 3 comprises a polygonal mirror 3*a*, onto which image formation light modulated with image formation signals is projected from a laser diode (unillustrated). The polygonal mirror 3*a* is rotated at a high velocity by a scanner motor (unillustrated), and the light reflected by the polygonal mirror 3*a* is projected onto the charged peripheral surface of the photosensitive drum 1, by way of a focusing lens 3*b*, a deflection mirror 3*c*, and the like, to selectively expose the peripheral surface of photosensitive drum 1, so that an electrostatic latent image is formed on the peripheral surface of the photosensitive drum 1.

(Developing Apparatus)

The developing apparatus 4 comprises a rotary device 4A which is indexically rotatable about the shaft 4d with which the apparatus main assembly A1 is provided. It also comprises four developing devices 4Y, 4M, 4C, and 4Bk, which are mounted in the rotary 4A, and contain yellow, magenta, cyan, and black toners, correspondingly. When developing an electrostatic latent image on the photosensitive drum 1, a specific developing device which contains the toner to be adhered to the electrostatic latent image on the photosensitive drum 1 is positioned at the development position. In other words, the rotary device 4A is indexically rotated so that the specific developing device stops at the development position at which the specific developing device opposes the photosensitive drum 1, with the presence of a microscopic gap (approximately 300 $\mu$m) between the development sleeve 4*b* of the developing device and the photosensitive drum 1. After the positioning of the development sleeve 4*b* relative to the photosensitive drum 1, the electrostatic latent image on the photosensitive drum 1 is developed. This development process is carried out in the following manner. That is, the toner in the toner container of the developing device corresponds to the color into which the latent image is to be developed is sent to a coating roller 4*a* by a toner sending mechanism (unillustrated). The toner sent to the coating roller 4*d* is coated in a thin layer, while being triboelectrically charged, on the peripheral surface of the development sleeve 4*b* by the rotating coating roller 4*a* and a toner regulating blade 4*c*. Then, the development bias is applied between the development sleeve 4*b*, and the photosensitive drum 1 on which an electrostatic latent image has been formed. As a result, the toner on the development sleeve 4*b* is adhered to the electrostatic latent image on the photosensitive drum 1 to develop the latent image into a toner image. The developing apparatus is configured so that as any of the developing devices 4Y, 4M, 4C, and 4Bk is positioned at the development position, electrical connection is established between the development sleeve 4*b* of the development device at the development position, and the corresponding color development high voltage power source (unillustrated) with which the apparatus main assembly A1 is provided, so that voltage is selectively applied for each of different color development processes. The developing devices 4Y, 4M, 4C, and 4Bk are structured so that they can be individually mounted in the rotary device 4A, and the rotary device 4A is structured so that it can be removably installed in the apparatus main assembly A1.

(Transferring Apparatus)

The transferring apparatus 5 is an apparatus for transferring all at once a plurality of toner images onto a recording medium S. More specifically, the transferring apparatus 5 comprises an intermediary transfer belt 5*a*, which runs in the direction indicated by an arrow mark R5. A plurality of toner images are sequentially transferred (primary transfer) from the photosensitive drum 1 onto the transfer belt 5*a*, being placed thereon in layers. Then, this plurality of layered toner images are transferred all at once (secondary transfer) from the intermediary transfer belt 5*a* onto the recording medium S. In this embodiment, the intermediary transfer belt 5*a* is an approximately 440 mm long endless belt, and is supported by being stretched around three rollers: a driving roller 5*b*, a secondary transfer counter roller 5*c*, and a follower roller 5*d*. It also comprises a pressing roller 5*j*, which is disposed adjacent to the follower roller 5*d*. The transferring apparatus 5 is configured so that the pressing roller 5*j* is allowed to take two positions: a position at which the pressing roller 5*j* presses the intermediary transfer belt 5*a* against the photosensitive drum 1, and a position to which the pressing roller 5*j* retreats to allow the intermediary transfer belt 5*a* to be away from the photosensitive drum 1. The intermediary transfer belt 5*a* is caused to run in the direction of the arrow mark R5 by the rotation of the driving roller 5*b*. The transferring apparatus is also provided with a cleaning unit 5*e*, which is disposed outside the loop of the intermediary transfer belt 5*a*, and can be placed in contact with, or moved away from, the surface of the intermediary transfer belt 5*a*. This cleaning unit 5*e* is a unit for removing the transfer residual toner, i.e., the toner which remains on the intermediary transfer belt 5*a* after the plurality of the toner images on the intermediary transfer belt 5*a* are transferred (secondary transfer) all at once onto the recording medium S. More specifically, the cleaning unit 5*e* comprises a charge roller 5*f*, which is placed in contact with the intermediary transfer belt 5*a* to give the toner an electrical charge opposite in polarity to the electrical charge given when transferring the toner images. Then, the toner given the opposite electric charge is electrostatically adhered to the photosensitive drum 1, and is recovered by the cleaning apparatus 6 for the photosensitive drum 1, which will be described later. The method for cleaning the intermediary transfer belt 5*a* does not need to be limited to the above-described electrostatic cleaning method. For example, mechanical methods which employ a blade, a fur brush, or the like, or a combination of the electrostatic and mechanical methods, may be employed.

(Cleaning Apparatus)

The cleaning apparatus 6 is an apparatus that removes, with the use of a cleaning blade 6*a* (FIG. 3), the so-called transfer residual toner, i.e., the toner which fails to be transferred (primary transfer) and remains on the peripheral surface of the photosensitive drum 1 after the primary transfer process in which the toner image developed on the photosensitive drum 1 by the developing apparatus 4 is transferred (primary transfer) onto the intermediary transfer belt 5*a*. The toner removed from the peripheral surface of the photosensitive drum 1 by the cleaning blade 6*a* is stored in the cleaning means housing portion 11 of the process cartridge B, the capacity of which is sufficient to easily match the service life of the photosensitive drum 1. The toner stored in the cleaning means housing portion 11 of the process cartridge B is removed from the apparatus main assembly A1 as the process cartridge B is replaced with a fresh one Referring to FIG. 3. the cleaning means housing portion 11 comprises a plurality of removed toner conveying-storing chambers 17, each of which is provided with a removed toner conveying member 25, which is rotationally supported, so that the removed toner stored in the first removed toner conveying-storing chamber 17 in terms of proximity to the photosensitive drum 1, is conveyed to the second removed toner conveying-storing chamber 17 by the removed toner conveying member 25 in the first chamber 17, and then, to the third chamber 17 by the removed toner conveying member 25 in the second chamber 17, and so on. the removed toner conveying member 25 is rotationally driven by being connected to a removed toner conveying coupling 20, which will be described later.

(Feeding-Conveying Apparatus)

The feeding-conveying apparatus 7 is an apparatus that feeds the recording medium S into the apparatus main assembly A1 and conveys it to the image forming portion of the apparatus main assembly A1. It comprises a sheet feeder cassette 7*a* which holds a plurality of recording medium S sheets, and is installed into the bottom portion of the apparatus main assembly A1. During an image forming operation, a pickup member 7*e* and a conveying roller 7*b* are rotationally driven in synchronism with the image forming operation, to feed one by one the sheets of recording medium S in the sheet feeder cassette 7*a*, out of the cassette 7*a*, and sequentially convey them to the intermediary transfer belt 5*a*. During the conveyance of the recording medium S to the intermediary transfer belt 5*a*, the recording medium S is guided by a guide plate 7*c*, and passes by a registration roller 7*d*.

(Fixing Apparatus)

The fixing apparatus 8 is an apparatus that fixes the plurality of the toner images, which have been transferred (secondary transfer) onto the recording medium S, to the recording medium S Referring to FIG. 1, the fixing apparatus 8 comprises a driving roller 8*a* which rotates to drive the recording medium S, and a fixing roller 8*b*, which is pressed upon the driving roller 8*a* to apply heat and pressure to the recording medium S. In operation, after passing by the transfer roller 5*n* for the secondary transfer for transferring all at once the plurality of the toner images on the intermediary transfer belt 5*a* onto the recording medium S, the recording medium S is conveyed to the fixing apparatus 8, and is conveyed through the fixing apparatus 8 by the driving roller 8*a*. As the recording medium S is conveyed through the fixing apparatus 8, heat and pressure is applied to the recording medium S by the fixing roller 8*b*. As a result, the plurality of the toner images of different color are fixed to the surface of the recording medium S. Then, the recording medium S is discharged into a delivery tray 10, which is located at the top of the apparatus main assembly A1, by the sheet discharging apparatus 9 which comprises a belt 9*a* which moves in the direction indicated by an arrow mark in the drawing, and discharge rollers 9*b* around which the belt 9*a* is wrapped to be driven.

(Installation and Removal of Process Cartridge into and out of Apparatus Main Assembly)

Next, referring to FIGS. 2, 13 and 14, the installation and removal of the process cartridge will be described.

Figure 2:
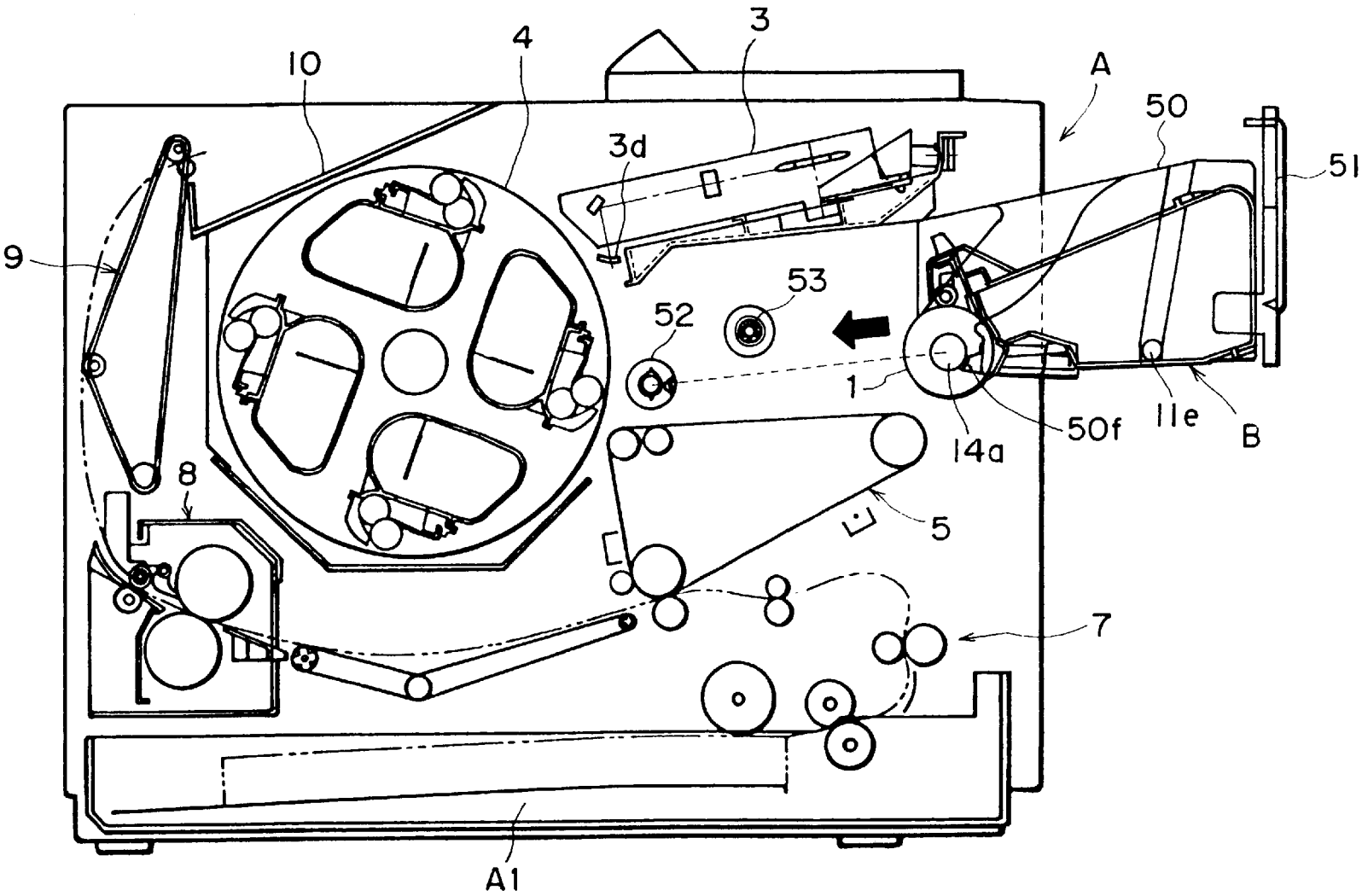
FIG. 2 is a schematic, vertical, and sectional view of the image forming apparatus in accordance with the present invention, and depicts how a process cartridge in accordance with the present invention is installed into, or removed from, the main assembly of the image forming apparatus in accordance with the present invention.

Referring to FIG. 2, the process cartridge B is installed into the apparatus main assembly A1 by a movable member 50 for guiding the process cartridge B into the apparatus main assembly A1. The movable member 50 is structured so that it can be moved in the direction substantially parallel to the direction in which the recording medium 2 is conveyed in the apparatus main assembly A1. The process cartridge B is removably placed in the movable member 50 after the movable member 50 is drawn out of the apparatus main assembly A1.

Figure 13:
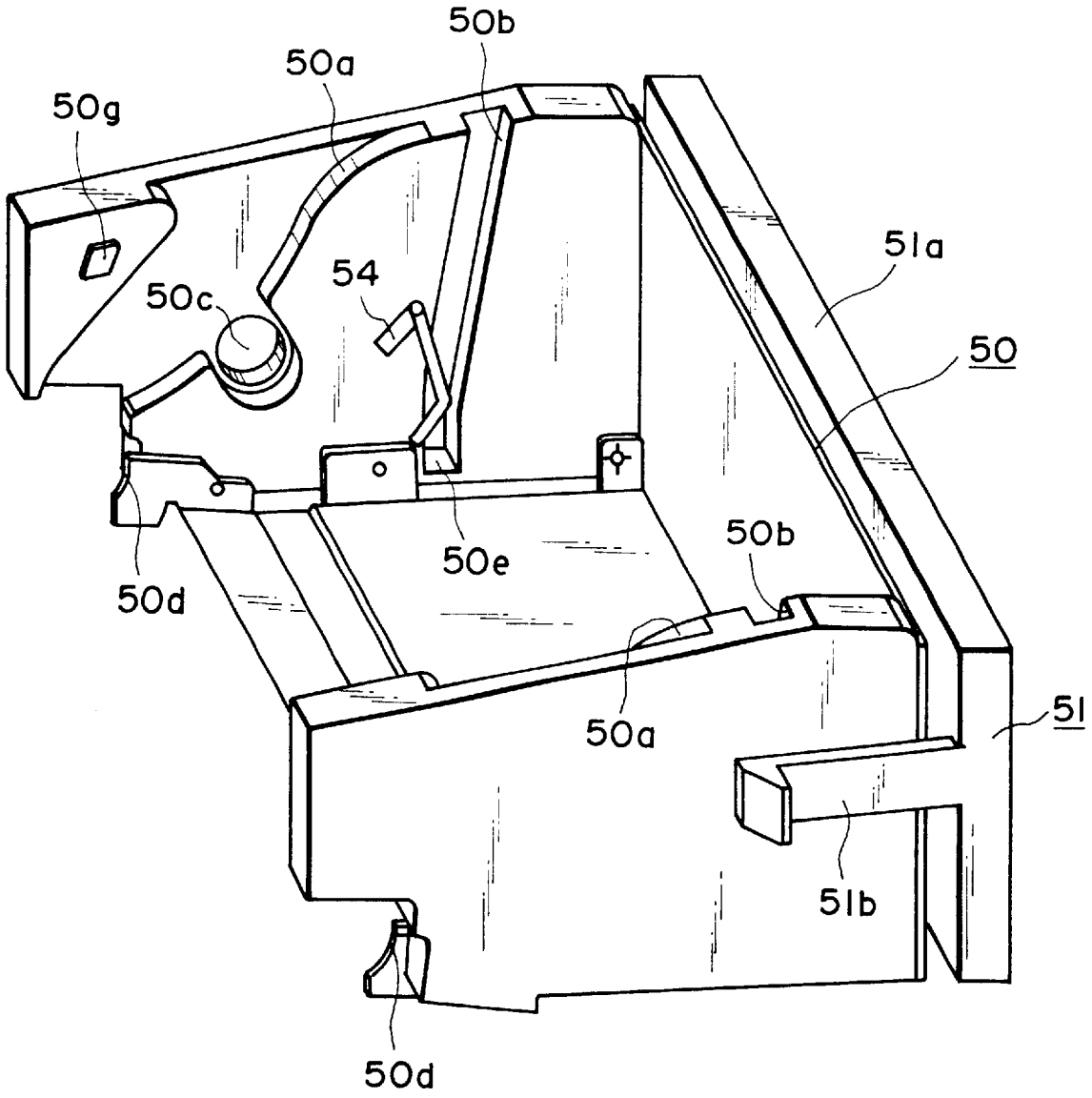
FIG. 13 is a perspective view of a movable member for installing the process cartridge into the main assembly of the image forming apparatus
Figure 14:
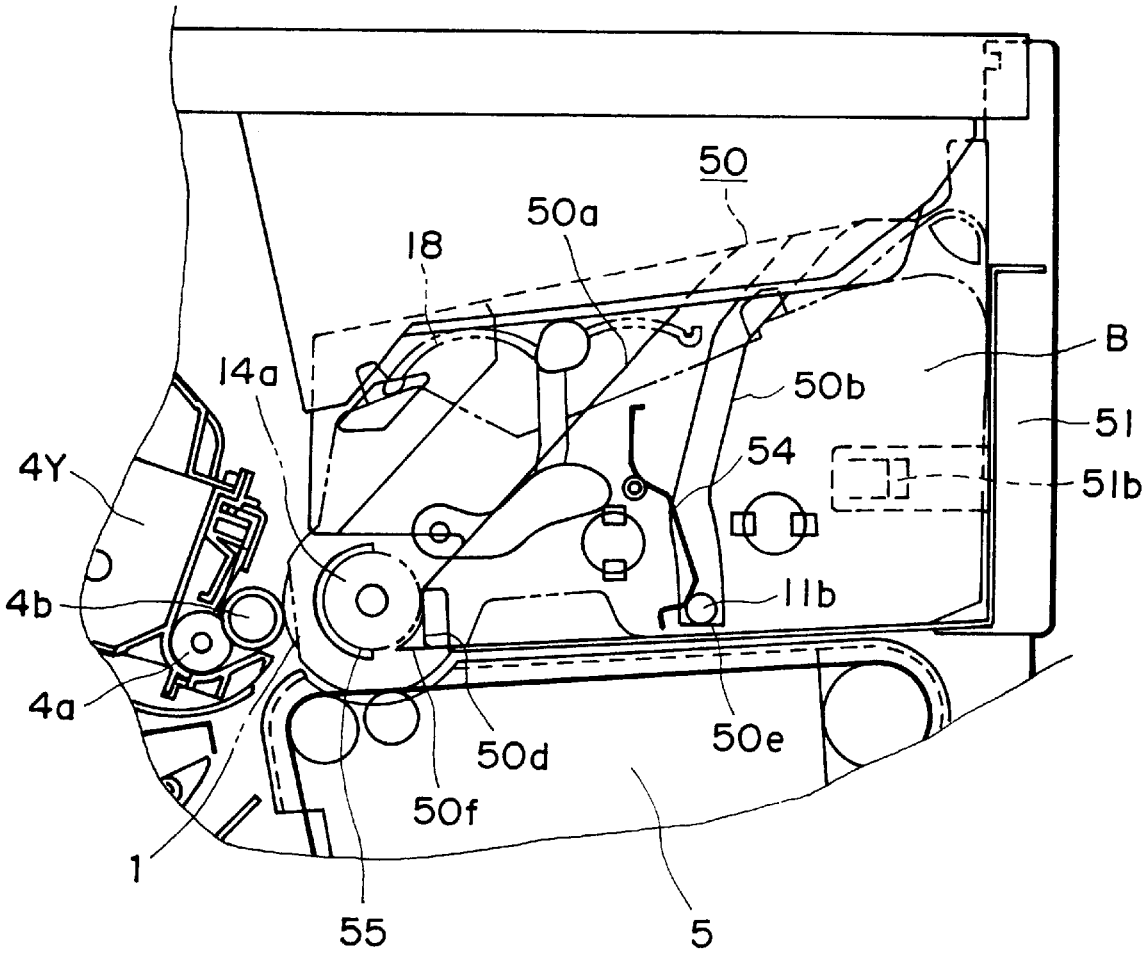
FIG. 14 is a schematic vertical sectional view of a portion of the main assembly of the image forming apparatus in which the process cartridge has been installed, and depicts the state of the process cartridge in the main assembly.

More specifically, referring to FIGS. 13 and 14, as the process cartridge B is placed into the movable member 50, the drum coupling 19 (corresponding to the cylindrical portion 14*b* of the side cover 14 on the opposing side of the process cartridge B) of the process cartridge B is guided by the first guiding surface 50*a* of the movable member 50, and at the same time, the rotation control projection 11*a* (rotation control projection 11*b* on the other side) of the process cartridge B is guided by the second guiding surface 50*b* of the movable member 50. The cylindrical positioning boss 13*a* (cylindrical positioning boss 14*a* on the other side) of the process cartridge B, which will be immediately next to, and coaxial with, the drum coupling 19 after the completion of the process cartridge installation, enters a temporary holding portion 50*f* located at the deepest end of the first guiding surface 50*a* (FIG. 2). Then, the process cartridge B pivots clockwise as if it were pivoting about the center of the temporary holding portion 50*f*. As a result, the rotation control projection 11*a* (rotation control projection 11*b* on the other side) of the process cartridge B comes in contact with the rotation control portion 50e located at the deepest end of the second guiding surface 50*b* of the movable member 50. Then, the projection 11*a* (11*b*) is pressed by a cartridge pressing member 54 with which the movable member 50 is provided. This ends the installation of the process cartridge B into the movable member 50.

Figure 12:
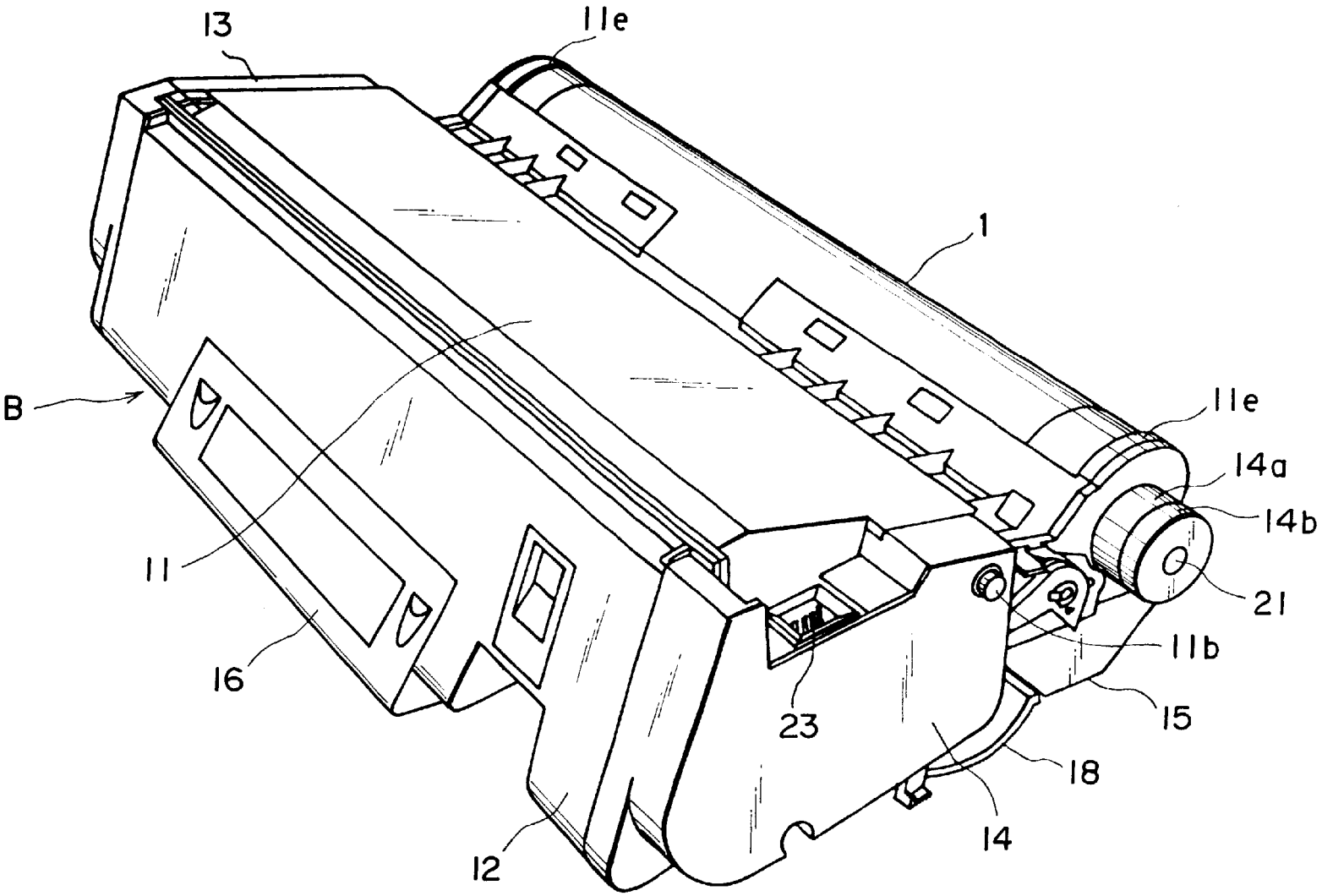
FIG. 12 is a perspective view of the upside-down process cartridge as seen from above the left rear corner.

During the above-described process cartridge installation process, the ROM connector 23 of the process cartridge B, which is illustrated in FIG. 12, becomes connected with an unillustrated connector disposed in the movable member 50. Further, a drum shutter 18 is opened halfway by a cam contact portion 50*g* with which the movable member 50 is provided.

After the process cartridge B is placed in the movable member 50, the movable member 50 is moved toward the apparatus main assembly A1 (FIG. 2). As the movable member 50 moves, the cylindrical positioning boss 13*a* of the process cartridge B (which corresponds to the cylindrical positioning boss 14*a* on the other side) is caught by the cartridge catching member 55 (first positioning member, and hereinafter, "CRG catching member"). At the same time, the hook portion 51*b* of the pressing portion 51 which is on the rear side of the movable member 50 locks into the side wall of the apparatus main assembly A1, maintaining the pressure applied to the movable member 50 by the rear plate 51*a* of the pressing portion 51. As a result, the abutting portion (second positioning portion) 50*d* located at the bottom front end of the movable member 50 presses the cylindrical positioning projection 13*a* (which corresponds to the cylindrical positioning boss 14*a*) of the process cartridge B against the CRG catching member 55, accurately positioning the process cartridge B relative to the apparatus main assembly A1 as shown in FIG. 1, so that an image forming operation can be carried out.

Also during the inward movement of the movable member 50, the gear cover 13 of the process cartridge B moves toward the drum driving coupling 52 and removed toner conveying member driving coupling 53 with which the apparatus main assembly A1 illustrated in FIG. 2 is provided Then, the drum driving coupling 52 (driving force transmitting member) engages with the drum driving coupling 19 (driving force receiving member) of the process cartridge B, and the removed toner conveying member driving coupling 53 engages with the removed toner conveying member driving coupling 20 through the hole 50*c* made through the side wall of the movable member 50. As a result, it becomes possible for the drum coupling 19 and removed toner conveying member coupling 29 of the process cartridge B to be driven.

Figure 5:
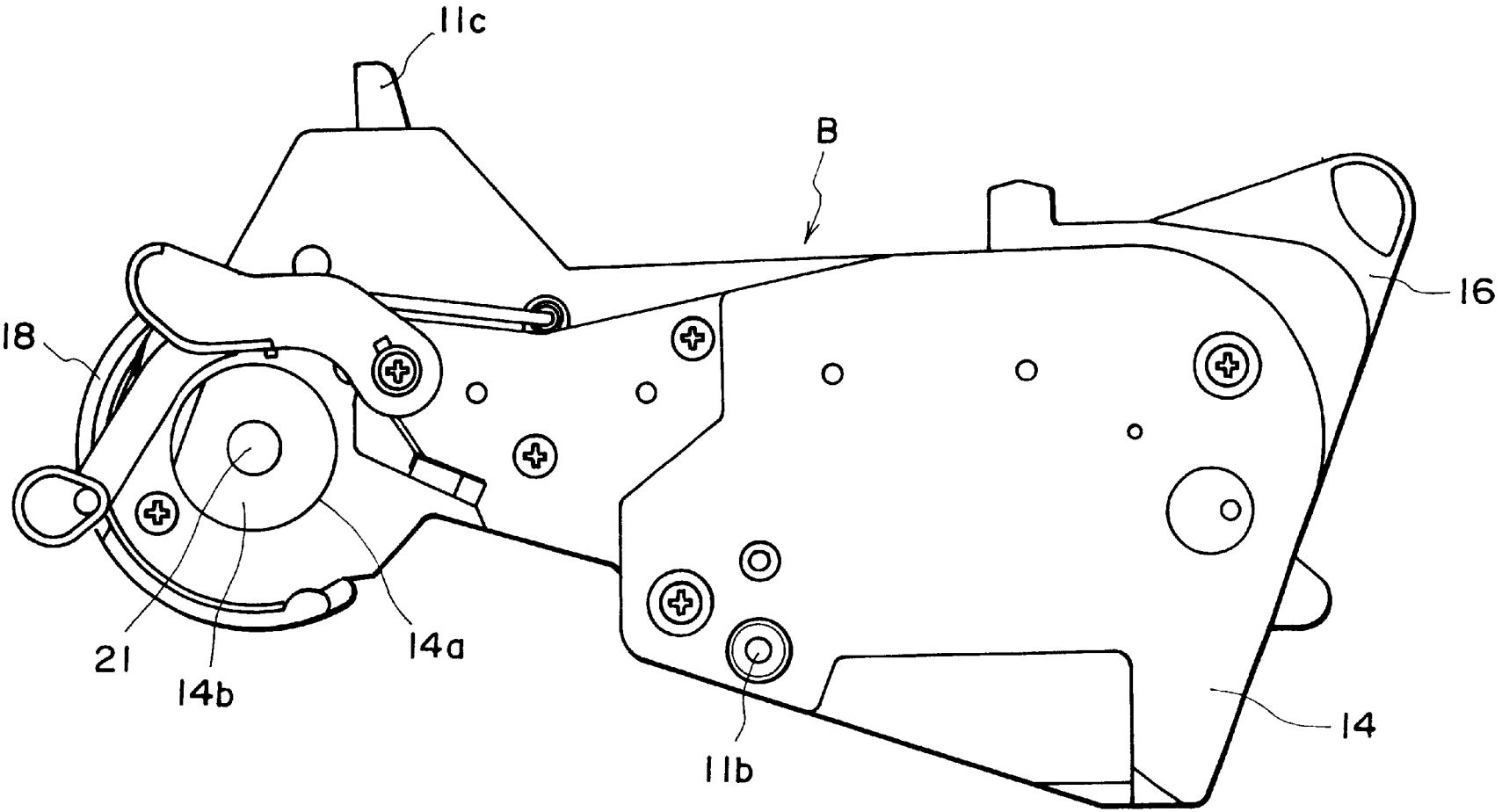
FIG. 5 is a left side view of the process cartridge.
Figure 6:
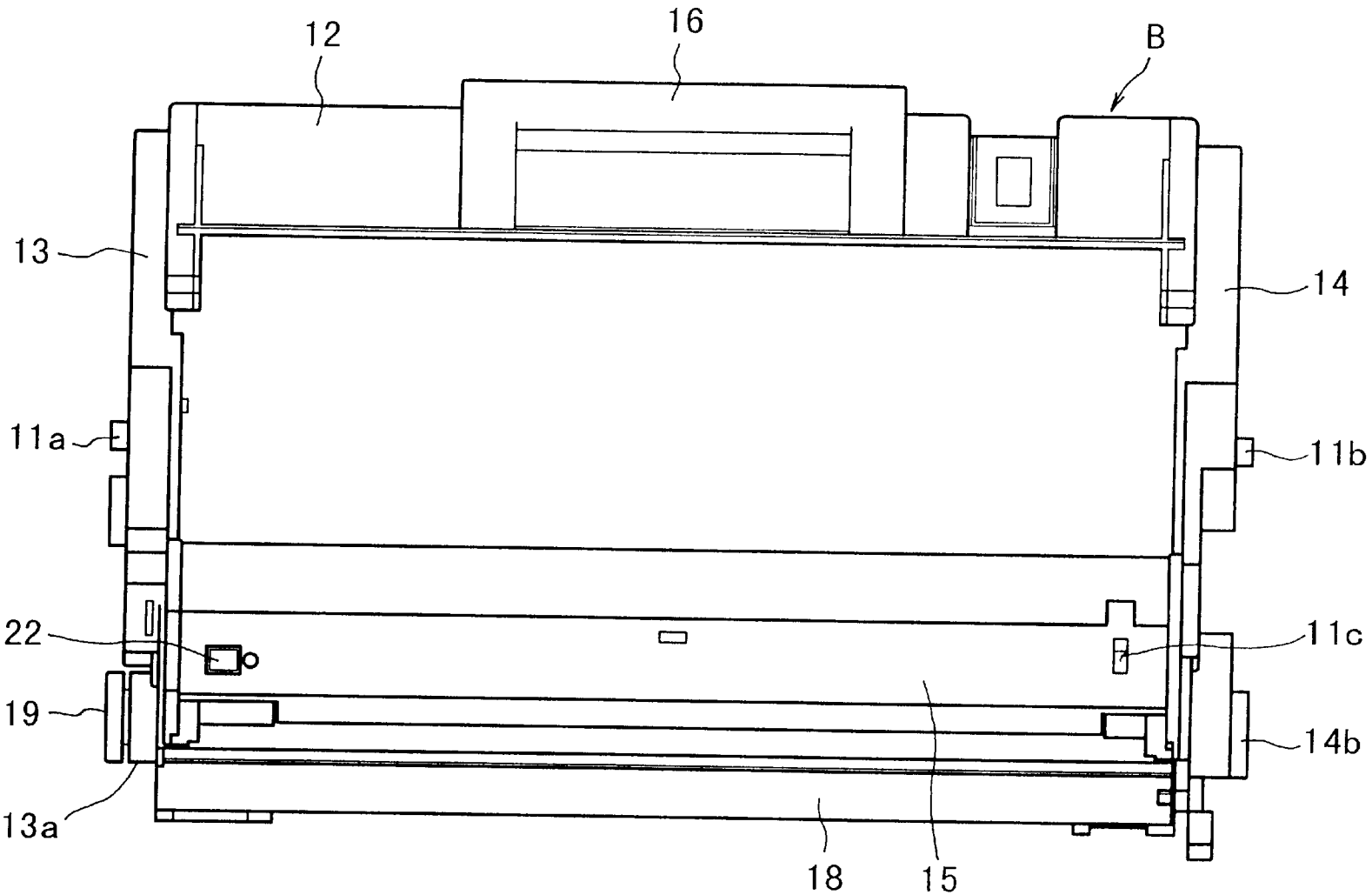
FIG. 6 is a top view of the process cartridge.
Figure 7:
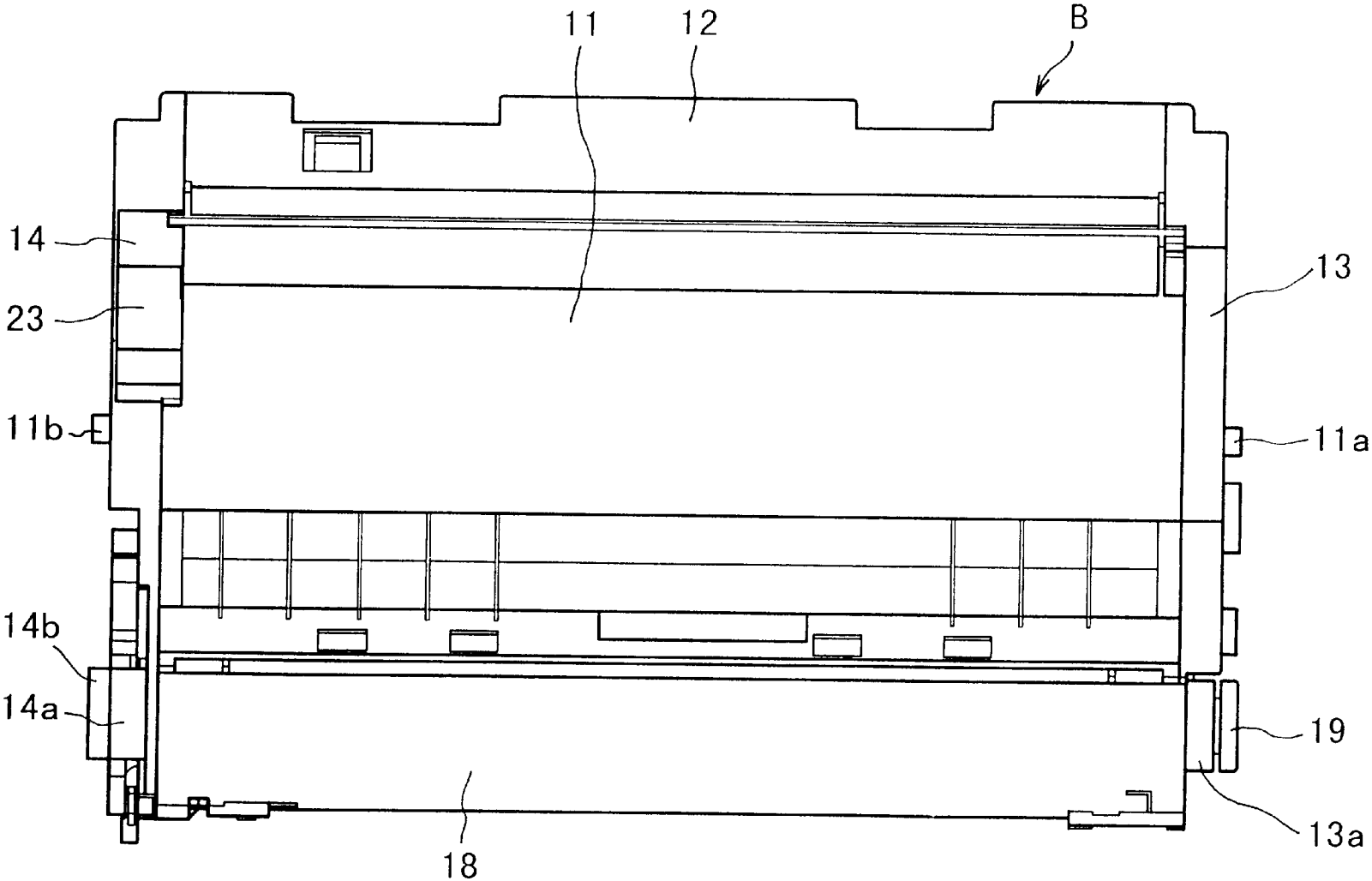
FIG. 7 is a bottom view of the process cartridge.
Figure 8:
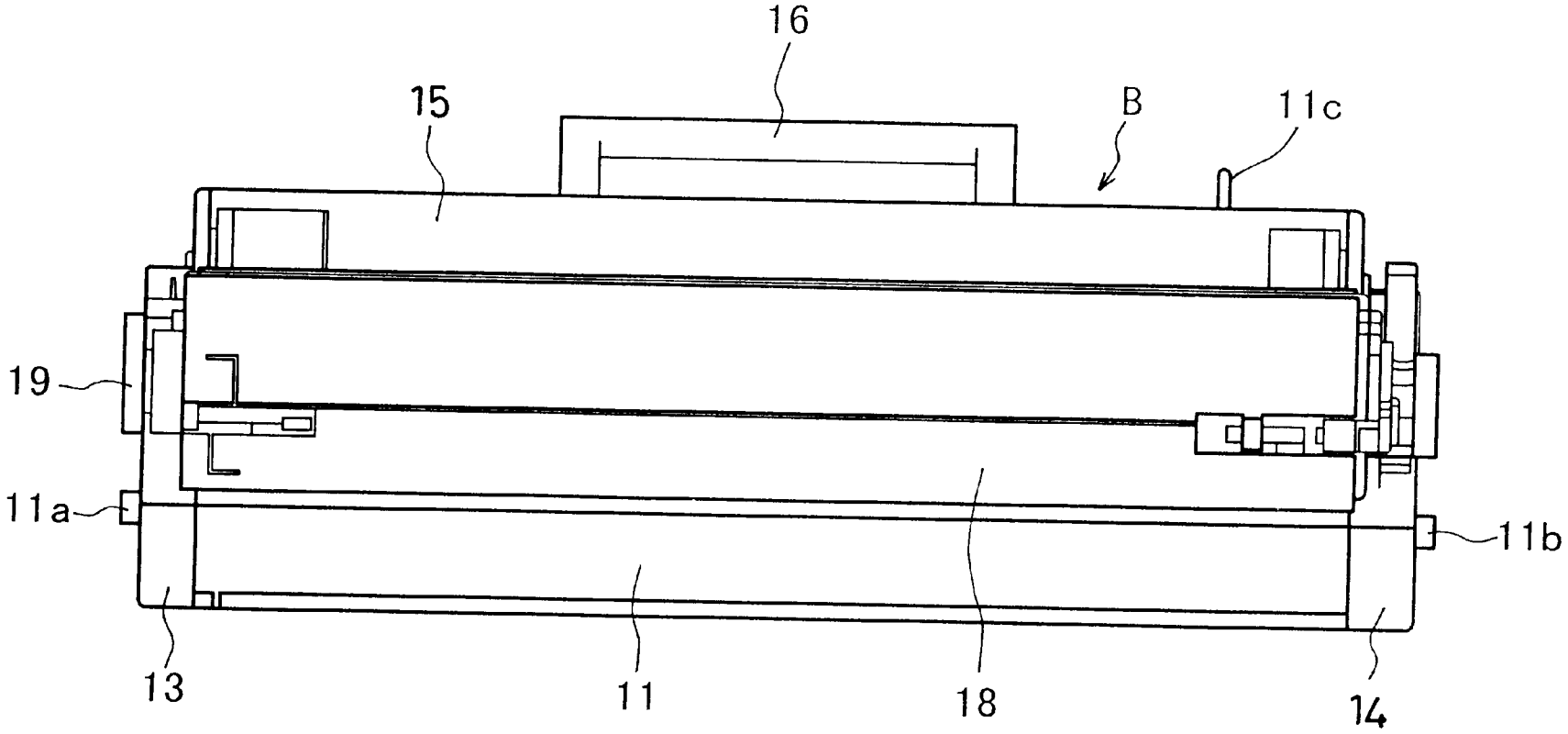
FIG. 8 is a front view of the process cartridge.
Figure 9:
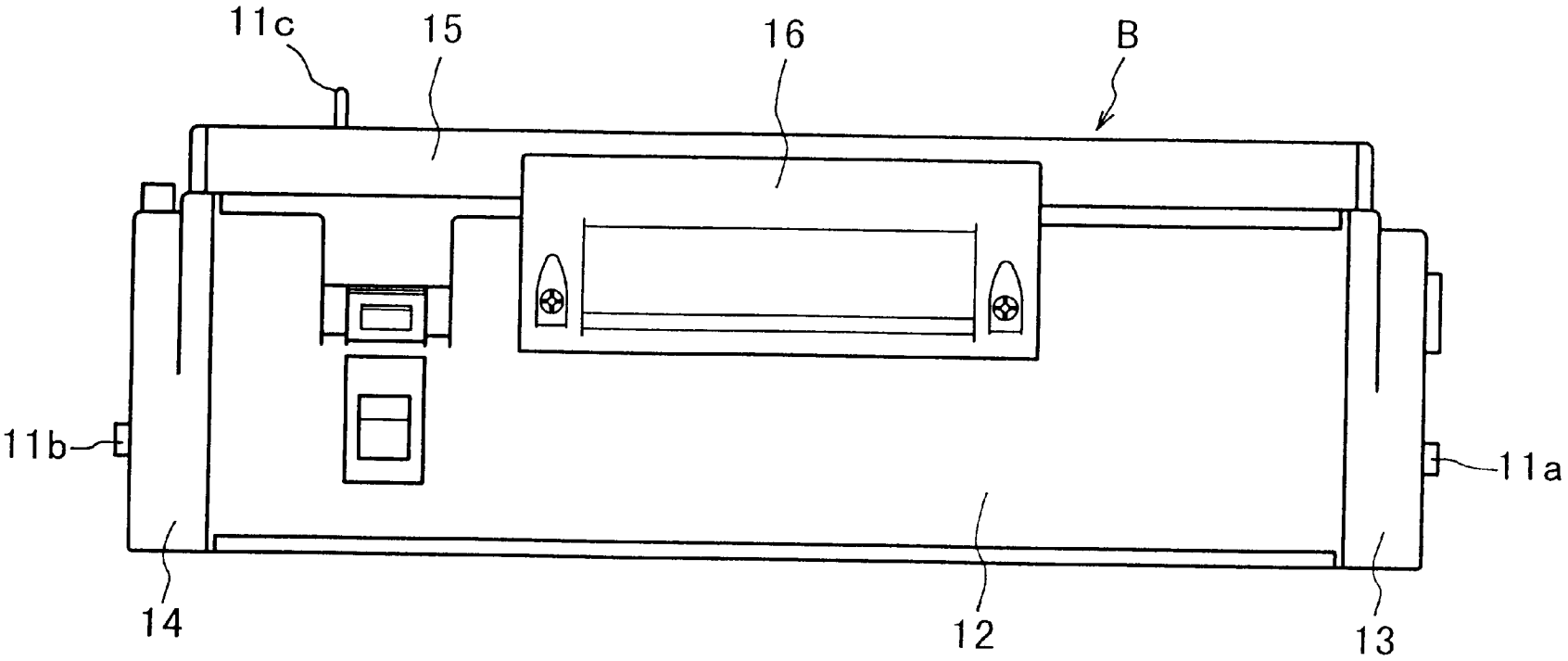
FIG. 9 is a rear view of the process cartridge.
Figure 10:
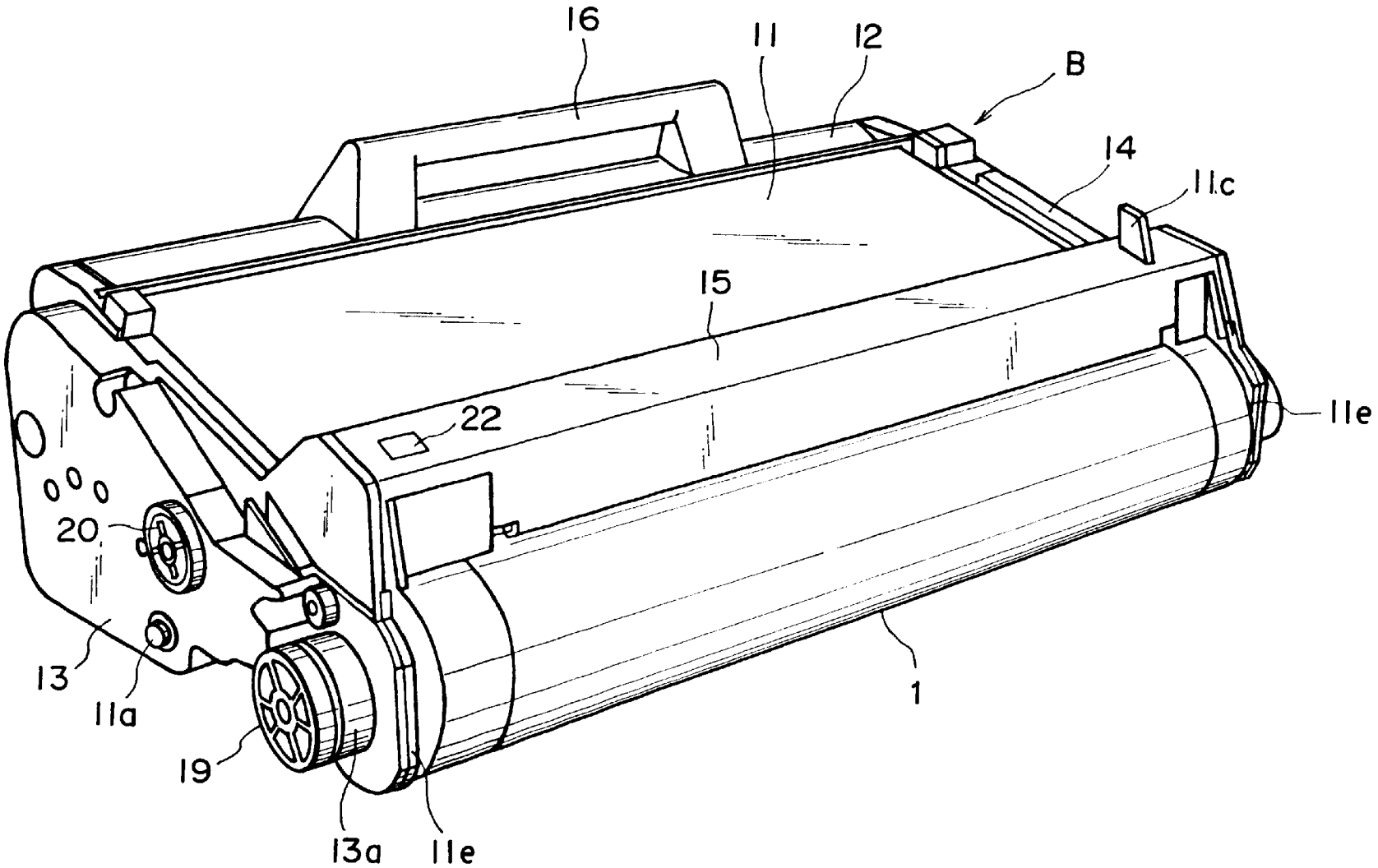
FIG. 10 is an external perspective view of the process cartridge as seen from above the right front corner.
Figure 11:
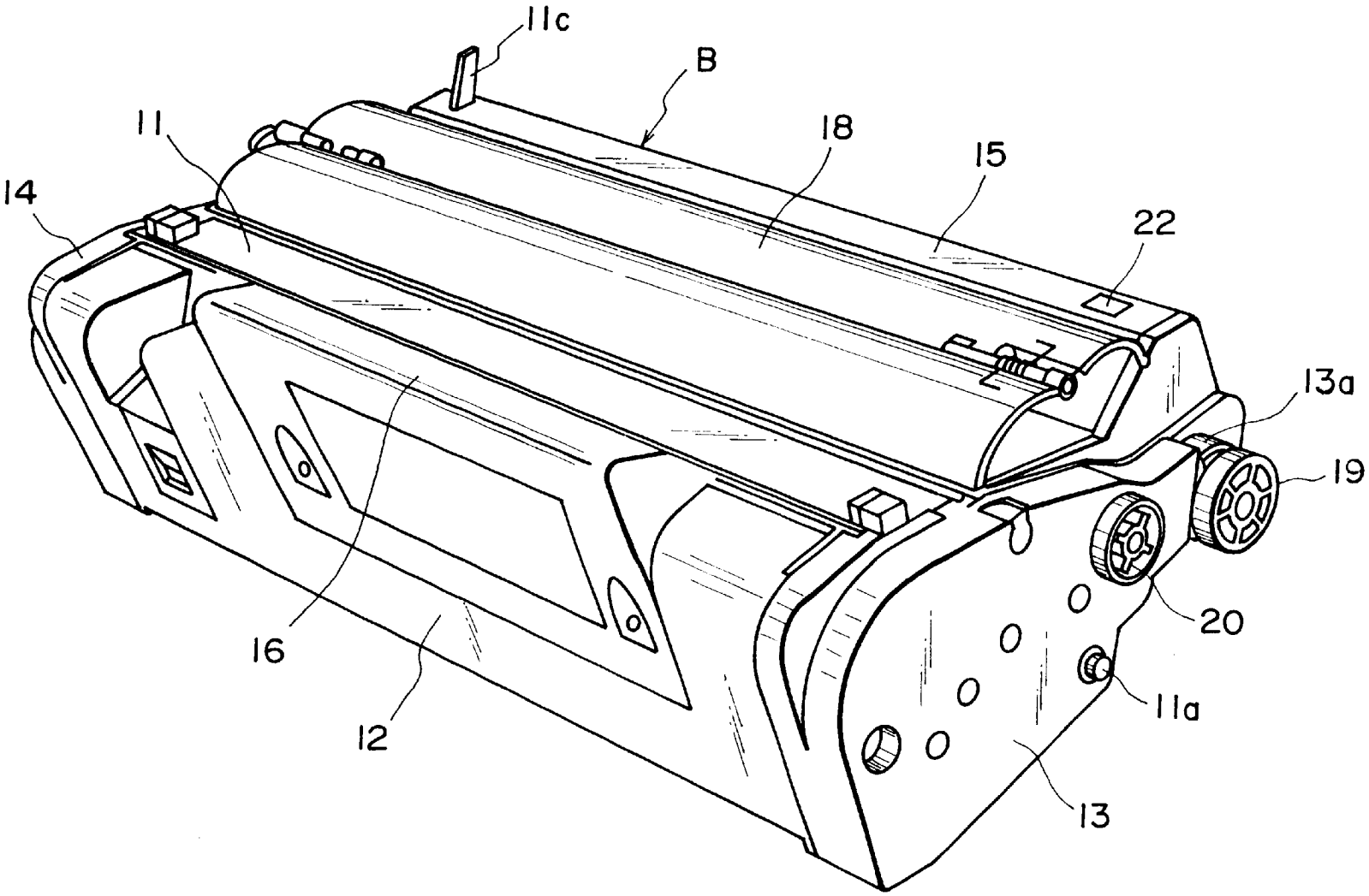
FIG. 11 is an external perspective view of the process cartridge as seen from above the right rear corner.

Also during the above described inward movement of the movable member 50, the laser shutter opening-closing rib 11c of the process cartridge B opens the laser shutter 3*d* of the exposing apparatus 3 illustrated in FIGS. 1 and 2. Further, the drum grounding contact 21 (FIG. 5) located at the center of the end of cylindrical portion 14*b* of the process cartridge B, on the non-driven side, and the primary bias contact 22 (FIG. 6) exposed through the charging apparatus cover 15 of the process cartridge B, are electrically connected to the unillustrated high voltage contact of the apparatus main assembly A1. Further, the drum shutter 18 is fully opened by an unillustrated shutter opening-closing rib of the apparatus main assembly A1.

(Image Forming Operation)

Next, referring to FIG. 1, the image forming operation of the image forming apparatus A in this embodiment will be described.

The photosensitive drum 1 is rotated in the direction (counterclockwise direction) indicated by an arrow mark in FIG. 1, in synchronism with the rotation of the intermediary transfer belt 5*a*, so that the peripheral surface of the photosensitive drum 1 is uniformly charged by the charging apparatus 2. Then, light, which corresponds to the yellow component of an image to be formed, is projected from the exposing apparatus 3 to expose the charged peripheral surface of the photosensitive drum 1. As a result, an electrostatic latent image corresponding to the yellow component of the image to be formed is formed on the peripheral surface of the photosensitive drum 1. In synchronism with the formation of this electrostatic latent image, the developing apparatus 4 is driven to position the yellow component developing device 4Y at the development position, and voltage which has the same polarity as the polarity to which the peripheral surface of the photosensitive drum 1 has been charged, and has approximately the same potential level as the voltage applied to the charge roller, is applied to develop the electrostatic latent image on the photosensitive drum 1 by adhering yellow toner to the electrostatic latent image on the photosensitive drum 1. Then, the yellow toner image on the photosensitive drum 1 is transferred (primary transfer) onto the intermediary transfer belt 5*a* by applying voltage which is opposite in polarity to the toner, to the primary transfer roller 5*d* (follower roller).

After the completion of the primary transfer of the yellow toner image, the rotary device is rotated to move the next developing device, that is, the developing device corresponding to the color component to be developed next, to the development position where the developing device opposes the photosensitive drum 1, and the toner image formed by this cycle or the development process is transferred (primary transfer) onto the intermediary transfer belt 5*a*, in alignment with the yellow toner image on the intermediary transfer belt 5*a*. Then, the same operation as the one described above, which comprises the electrostatic image formation, development, and primary transfer, is carried out for the cyan and black components of the image to be formed. As a result, four toner images of different color are placed in layers on the intermediary transfer belt 5*a*. These four toner images of different color are transferred (secondary transfer) all at once onto the recording medium S supplied from the sheet feeding-conveying apparatus 7.

After the secondary transfer, the recording medium S is conveyed to the fixing apparatus 8, in which the toner images are fixed to the recording medium S. Then, the recording medium S is discharged into the delivery tray 10, by the belt 9*a* which moves in the direction indicated by the arrow mark in the drawing, and the discharge roller 9*b* around which the belt 9*a* is wrapped to be driven. This concludes the image forming operation.

(Structure of Process Cartridge Housing)

Next, referring to FIGS. 3–12, the structure of the process cartridge housing will be described.

Referring to FIG. 3, the process cartridge B comprises the charging apparatus 2 (C roller) and cleaning apparatus 6, which are disposed along the peripheral surface of the photosensitive drum 1. These components are integrally disposed in the housing 100 which can be removably placed in the aforementioned movable member 50 (installing means) with which the apparatus main assembly A1 is provided. The housing 100 of the process cartridge B comprises a cleaning means housing portion 11, and a rear housing portion 12 which is joined with the rear end of the cleaning means housing portion with the use of ultrasonic waves. The cleaning means housing portion 11 comprises: a pair of drum supporting portions 11*e* which extend from each longitudinal end of the housing 100; a cleaning blade supporting portion 11*d* which supports the cleaning blade 6*a* of the cleaning apparatus 6; and a roller supporting portion 11*f* which supports the charging apparatus 2. The rear housing portion 12 comprises a handle which an operator grasps when installing or removing the process cartridge B into and from the apparatus main assembly A1. Referring to FIGS. 4–12, the process cartridge B comprises a gear cover 13 (side cover for covering one of the longitudinal ends of process cartridge B), which is fixed to the process cartridge B, on the driven side of the longitudinal ends of the process cartridge B, to cover the longitudinal end of the cleaning means housing portion 11 and rear housing portion 12. To the other longitudinal end of the process cartridge B, a side cover 14 is fixed to cover the other longitudinal ends of the cleaning means housing portion 11 and rear housing portion 12. The gear cover 13 and side cover 14 are provided with the cylindrical positioning bosses 13*a* and 14*a* (positioning portions) and rotational control projections 11*a* and 11*b*, respectively. Further, the process cartridge B comprises a charging apparatus cover 15, which is fixed to the top portion of the cleaning means housing portion 11, and covers the charging apparatus 2 across the top as well as both longitudinal ends.

Further, the process cartridge B is provided with the drum shutter 1, which is movable along the peripheral surface of the photosensitive drum 1, and protects the photosensitive drum 1 by, for example, preventing the photosensitive drum 1 from being exposed to the external light and from coming into contact with the operator.

(Detailed Description of Means for Supporting Process Cartridge B)

Next, referring to FIG. 16, the structure which supports the process cartridge B by supporting the center of the process cartridge (axial line of photosensitive drum) will be described in detail As described above, as the installation of the process cartridge B into the apparatus main assembly A1 is completed, the center of the process cartridge B is accurately positioned by the cylindrical positioning bosses 13*a* and 14 which are integrally formed with the gear cover 13 and side cover 14, respectively. The axial lines of the cylindrical bosses 13*a* and 14*a* coincide with the axial. line of the photosensitive drum 1.

Figure 16:
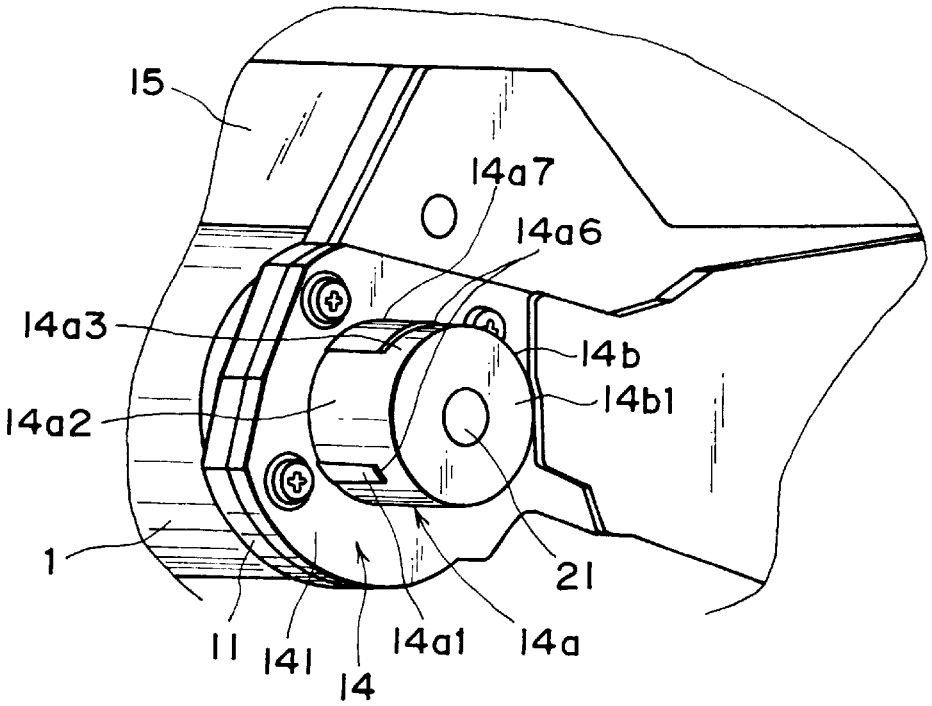
FIG. 16 is a perspective view of the cylindrical positioning boss of the process cartridge and its adjacencies.
Figure 16:
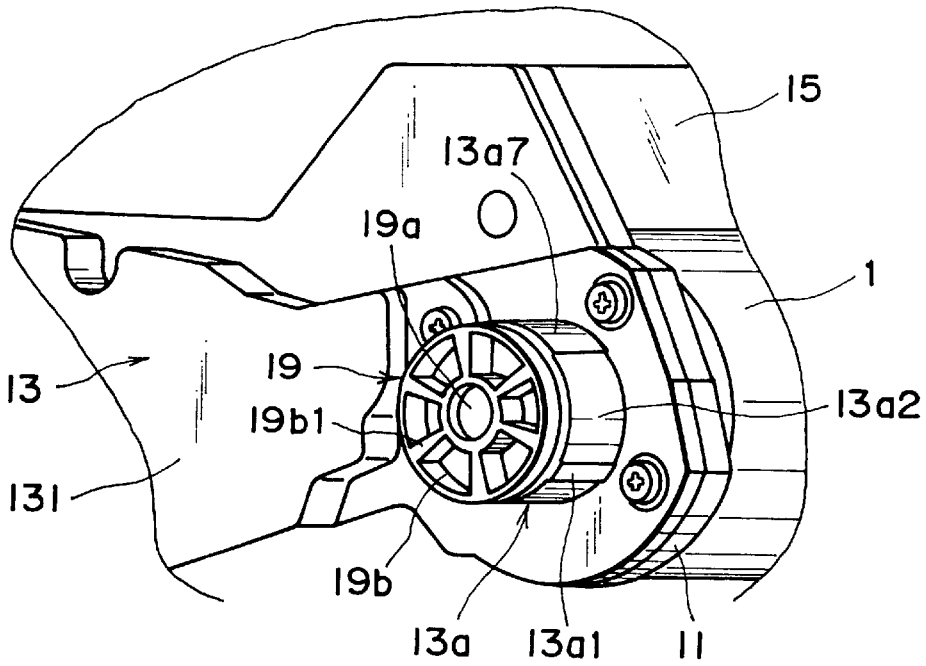

Referring to FIG. 16(*b*), the cylindrical boss 13*a*, i.e., the positioning boss on the driven side of the process cartridge B, is disposed immediately next to the drum coupling 19 attached to the drum supporting shaft 1*a*1 illustrated in FIG. 17(*a*), in terms of the axial direction of the photosensitive drum 1. In other words, the cylindrical positioning boss 13*a* is aligned with the drum coupling 19 in the axial direction of the photosensitive drum 1. The diameter D1 of the cylindrical positioning boss 13*a* is slightly larger than the diameter D2 of the drum coupling 19. The position of the outward end surface 13*a*6 of the cylindrical positioning boss 13*a* in terms of the longitudinal direction of the photosensitive drum 1 is the same as, or slightly inward of, the position of the outward surface 131 of the gear cover 13 in terms of the longitudinal direction of the photosensitive drum 1. The position of the outward surface 19*a* of the drum coupling 19 in terms of the longitudinal direction of the photosensitive drum 1 is on the outward side of the aforementioned outward surface 131. The relationship between the external diameter D1 of the cylindrical positioning boss 13*a* and the external diameter D2 of the drum coupling 19 is: D1>D2. D1 is approximately 28 mm and D2 is approximately 27.6 mm.

The cylindrical positioning boss 14*a* on the non-driven side is provided with a cylindrical portion 14*b* which is coaxial with the cylindrical positioning boss 13*a*, but is slightly smaller in external diameter than the cylindrical positioning boss 13*a* (FIG. 16(*a*)). In terms of the longitudinal direction of photosensitive drum 1, the position of the outward facing surface 14*a*6 of the cylindrical positioning boss 14*a* is the same as, or slightly on the inward side of, the position of the outward surface 141 of the side cover 14. Also in terms of the longitudinal direction of the photosensitive drum 1, the position of the outward surface 14*b*1 of the cylindrical portion 14*b* is on the outward side of the outward surface 141. The external diameter D3 of the cylindrical positioning boss 14*a* and the external diameter D4 of the cylindrical portion 14*b* have the following relationships relative to D1 and D2: D1=D3 and D2=D4.

Figure 15:
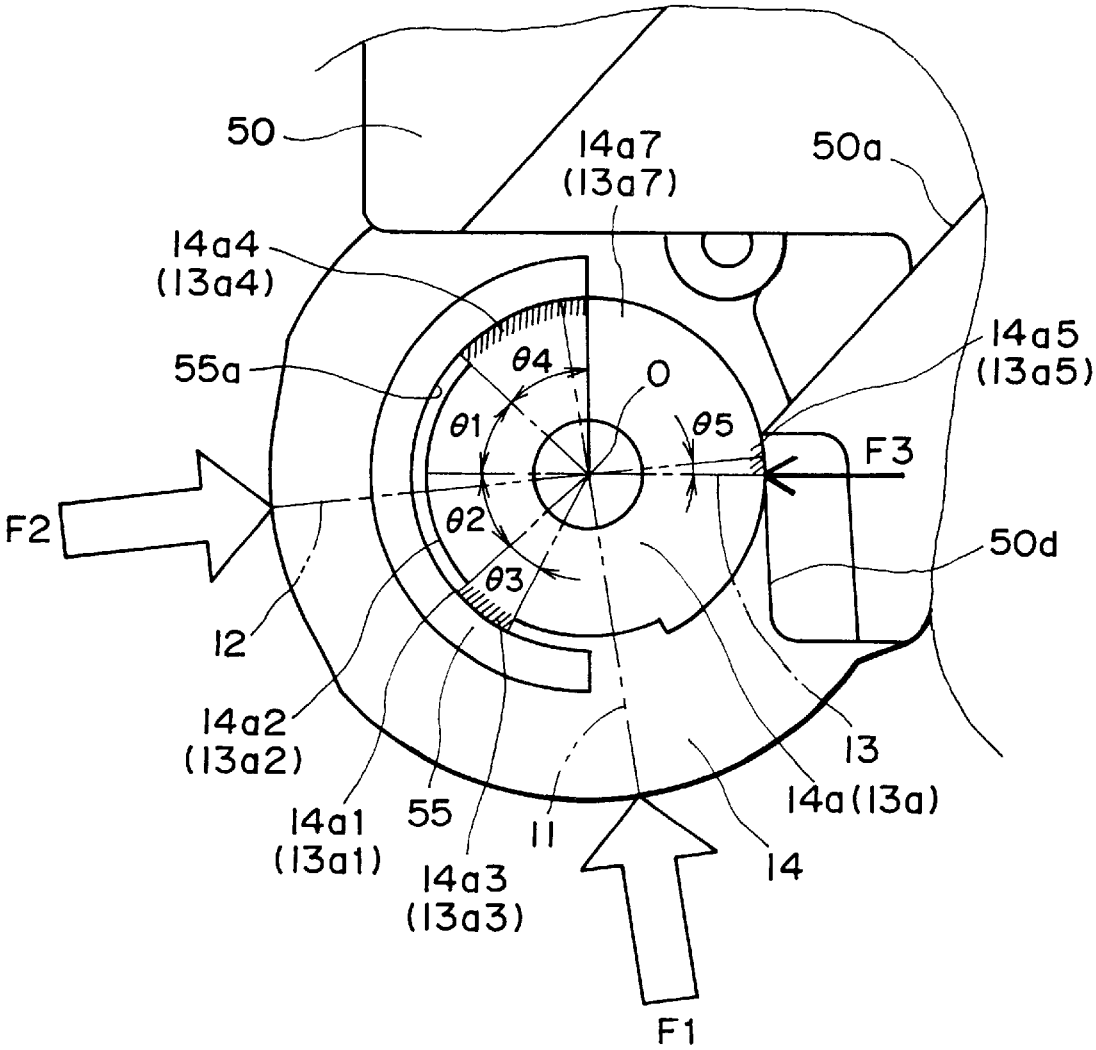
FIG. 15 is an enlarged vertical sectional view of the cylindrical positioning boss of the process cartridge and its adjacencies.

Referring to FIG. 15, the cylindrical positioning boss 14*a* (which corresponds to the cylindrical positioning boss 13*a* on the other side) is supported by the CRG catching member 55 while the process cartridge B is in the apparatus main assembly A1. The CRG catching member 55 is on the unillustrated side plate of the housing of the apparatus main assembly A1. The CRG catching member 55 is approximately semicircular in cross section, and its open side, i.e., the side corresponding to the inward side of the semicircular cross section, faces the direction from which the process cartridge B is inserted into the apparatus main assembly A1 (the direction from which the movable member 50 is moved toward the apparatus main assembly A1).

The cylindrical positioning boss 14*a* (13*a*) is provided with a first contact portion 14*a*5 (13*a*5), which corresponds to the butting portion 5*d* with which the movable member 50 is provided. This first contact portion 14*a*5 (13*a*5) is subjected to a load F3, i.e., a pressure of approximately 2.0 kgf directly applied to the contact portion 14*a*5 (13*a*5) by the butting portion 50*d*.

In order to control the position at which the load F3 is taken by the CRG catching member 55, the cylindrical positioning boss 14*a* (13*a*) is provided with a second contact portion 14*a*3 (13*a*3), and a third contact portion 14*a*4 (13*a*4), which are located on the peripheral surface of the cylindrical positioning boss 14*a* (13*a*). These contact portions 14*a*3 (13*a*3) and 14*a*4 (13*a*4) are distributed on the peripheral surface of the cylindrical positioning boss 14*a* (13*a*) so that the load F3 is evenly distributed between the two contact portions 14*a*3 and 14*a*4 (13*a*3 and 13*a*4). More specifically, the contact portions 14*a*3 and 14*a*4 (13*a*3 and 13*a*4) are distributed on the peripheral surface of the cylindrical positioning boss 14*a* (13*a*) so that the angles θ1 and θ2 which the third and second contact portions 14*a*4 (13*a*4) and 14*a*3 (13*a*3) form, respectively, relative to the transverse line of action 13 of the load F3 perpendicular to the axial line of the photosensitive drum 1 become the same (θ1=θ2). Further, the second and third contact portions 14*a*3 and 14*a*4 (13*a*3 and 13*a*4) come in contact with the inwardly facing surface of the CRG catching member 55.

The third contact portion 14*a*4 (13*a*4) is a part of the first projection 14*a*7 (13*a*7) which includes the first contact portion 14*a*5 (13*a*5). The second contact portion 14*a*3 (13*a*3) is a part of the second projection 14*a*1 (13*a*1). The intervals between the first and second projections 14*a*7 (13*a*7) and 14*a*1 (13*a*1) form recesses 14*a*2 (13*a*2) which do not come in contact with the CRG catching member 55.

Therefore, the process cartridge B is accurately positioned by three contact portions distributed in the above described manner, on the peripheral surface of the cylindrical positioning boss 14*a* (13*a*) in the circumferential direction of the cylindrical positioning boss 14*a* (13*a*): the first contact portion 14*a*5 (13*a*5) which comes in contact with the butting portion 50*d* of the movable member 50, and the second and third contact portions 14*a*3 and 14*a*4 (13*a*3 and 13*a*4) which make contact with the CRG catching member 55 of the apparatus main assembly A1. With this arrangement, it is possible to eliminate the unwanted play between the cylindrical bosses 14*a* (13*a*) and the movable member 50.

In the color image forming apparatus A in this embodiment, four color developing devices 4Y, 4M, 4C, and 4Bk held by the rotary device 4A make contact with the photosensitive drum 1 one after another, and a load F2 (external force) is applied to the photosensitive drum 1 for every development process. Further, even though the intermediary transfer belt 5*a* or the like of the transferring apparatus 5 is away from the photosensitive drum 1 when an image is not formed, it must make contact with the photosensitive drum 1 when the toner image on the photosensitive drum 1 is transferred (primary transfer) onto the intermediary transfer belt 5*a*. Thus, during the primary transfer, a load (external force) F1 is applied to the photosensitive drum 1. Therefore, in order to take the load F1, the second contact portion 14*a*4 (13*a*4) which stands in the way of the transverse line of action 11 of the load F1 it extended toward the first contact portion 14*a*5 (13*a*5) following the circumference of the cylindrical positioning boss 14*a* (13*a*). The load F2 is taken by the first contact portion 14*a*5 (13*a*5) which stands in the way of transverse line of action 12 of the load F2.

Thus, the cylindrical positioning boss 14*a* (13*a*) has only to be formed so that the dimensions of the contact portions of the cylindrical positioning boss 14*a* (13*a*) in terms of the central angles which the contact portions form with the center of the cylindrical positioning boss 14*a* (13*a*) satisfy the following requirement That is, the central angle θ5 for the first contact portion 14*a*5 (13*a*5) becomes approximately 5°; the central angle θ3 for the second contact portion 14*a*4 (13*a*4), approximately 10°; and the central angle θ4 for the third contact portion 14*a*3 (13*a*3) becomes approximately 40°. The interval portions among the these contact portions 14*a*5 (13*a*5), 14*a*4 (13*a*4), and 14*a*3 (13*a*3) are formed into recesses 14*a*2 (13*a*2) which are stepped down from the peripheral surfaces of the contact portions by approximately 0.5 mm, to be prevented from coming in contact with the inward surface 55*a* of the CRG catching member 55.

As described above, in the case of the process cartridge B in this embodiment, the cylindrical positioning bosses 13*a* and 14*a* are supported by the movable member 50 and CRG catching member 55, by the three contact portions 14*a*5 (13*a*5), 14*a*4 (13*a*4), and 14*a*3 (13*a*3). Therefore, it does not occur that the position of the photosensitive drum 1 changes due to the shock which is generated when the position of the developing devices 4Y, 4M, 4C, or 413k in the process cartridge B relative to the photosensitive drum 1 is switched, or the shock which is generated when the intermediary transfer belt 5*a* of the transferring apparatus 5 is placed in contact with, or moved away from, the photosensitive drum 1. Therefore, the so-called color aberration, i.e., the image detect caused by the failure of the four toner images of different color to be accurately aligned when they are transferred onto the Intermediary transfer belt 5*a*, is prevented, making it possible to enable a color image forming apparatus to output flawless images.

Further, the three contact portions 14*a*5 (13*a*5), 14*a*4 (13*a*4), and 14*a*3 (13*a*3), which the movable member 50 and CRG catching member 55 catch, are either a part of the projection 14*a*7 (13*a*7), or in the form of the projection 14*a*1 (13*a*1), adding to the strength of the cylindrical positioning bosses 13*a* and 14*a*, which in turn conceivably increases the rigidity of the structure which supports the process cartridge B in the apparatus main assembly A1.

In this embodiment, three contact portions are strategically distributed on the peripheral surface of each of the cylindrical positioning bosses 13*a* and 14*a* in the circumferential direction. However, more than three contact portions may be distributed on the peripheral surface of each of the cylindrical positioning bosses 13*a* and 14*a* in the circumferential direction.

(Detailed Description of Drum Coupling)

Figure 18:
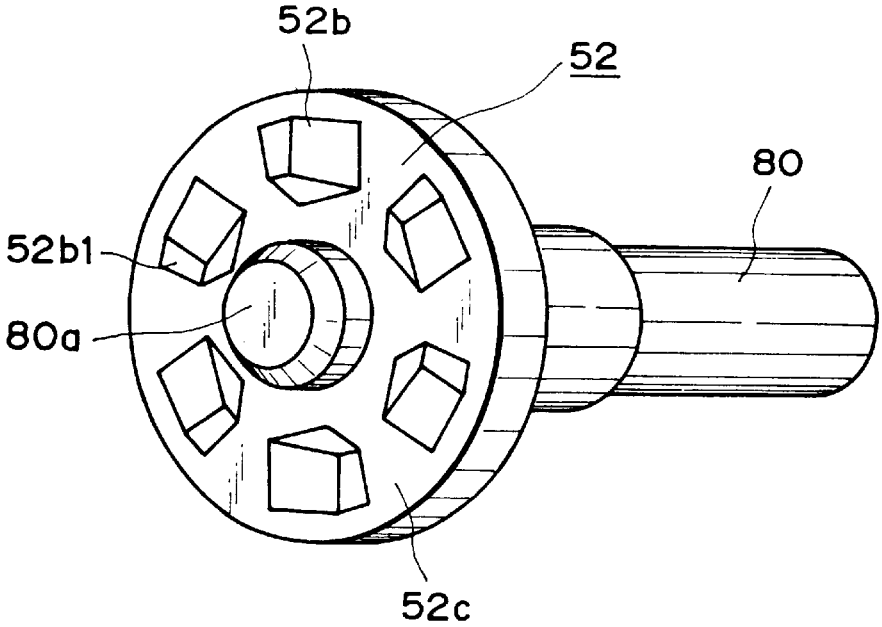
FIG. 18(*a*) is a perspective view of the drum driving coupling of an electrophotographic image forming apparatus, and FIG. 18(*b*) is a perspective view of the drum driving coupling of a process cartridge.
Figure 18:
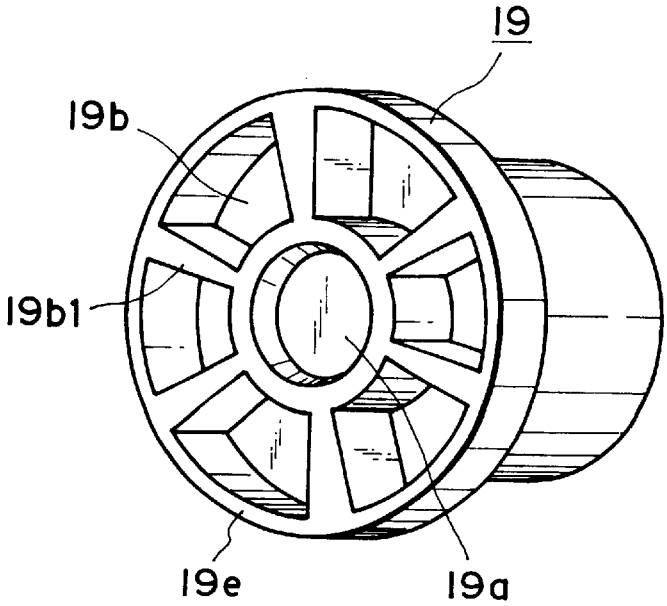

Next, referring to FIGS. 17 and 18, the structure of the drum coupling 19 will be described in detail.

The photosensitive drum 1 is rotationally supported by the drum supporting portion 11*e* of the cleaning means housing portion 11 of the process cartridge B. The photosensitive drum 1 comprises the aluminum cylinder 1*c*, and a drum flange 1*a* which is partially inserted into the aluminum cylinder 1*c*, on the driven side, and fixed thereto by such a method as bonding or crimping. The drum flange 1*a* is provided with the drum supporting shaft 1*a*1, which extends from the center of the outward surface of the drum flange 1*a*. The drum supporting shaft 1*a*1 is formed separately from the drum flange 1*a* and attached to the drum flange 1*a* by its largest diameter portion 1*a*11 by pressing, or insert molding.

The drum supporting shaft 1*a*1 is fitted in the drum supporting portion 11*d* of the cleaning means housing portion 11, and the cylindrical positioning boss 13*a* of the gear cover 13. More specifically, the drum supporting shaft 1*a*1 is put through the ball bearing 111, which is embedded in the drum supporting portion 11*d* and gear cover 13 so that it does not displace in the axial direction of the photosensitive drum 1. In other words, the drum supporting shaft 1*a*1 is rotationally supported by the ball bearing 111.

The drum supporting shaft 1*a*1 is provided with the drum coupling 19, which is fitted around the longitudinal end of the drum supporting shaft 1*a*1 The drum coupling 19 is a member for receiving the rotational driving force from the drum driving coupling 52 of the apparatus main assembly A1. Referring to FIG. 17(*a*), the D-cut portion 1*a*3 of the drum supporting shaft 1*a*1 is press-fitted in the D-cup hole 19*c* of the drum coupling 19, and the pawl 19*d*, which is a part of the wall of the D-cut hole 19*c* of the drum coupling 19, is in engagement with the groove 1*a*2 which is cut in the curved surface 1*a*12 of the D-cut portion 1*a*3 of the drum supporting shaft 1*a*1 so as to extend in parallel to the curvature of the curved surface 1*a*12. With this arrangement, the drum coupling 19 does not slip off from the drum supporting shaft 1*a*1.

Referring to FIGS. 17(*a*) and 18(*b*), the drum coupling 19 is provided with a cylindrical engagement hole 19*a*, which is made in the surface 19*e* which faces the apparatus main assembly A1. The axial line of the hole 19*a* coincides with the axial line of the photosensitive drum 1. The drum driving coupling shaft 80 fits into this hole 19*a*. Further, the drum coupling 19 is provided with an additional six engagement holes 19*b*, which are also made in the surface 19*e*. The engagement holes 19*b* have a cross section in the form of a fan, and are provided for transmitting the driving force The engagement holes 19*b* are evenly distributed around the engagement hole 19*a*. The surface 19*b*1 of each engagement hole 19*b* made in the surface 19*e* of the drum coupling 19, that is, the surface which takes the rotationally driving force from the drum driving coupling 52, extends in the radial direction of a theoretical circle, the center of which coincides with the center of the engagement hole 19*a*.

The drum driving coupling 52 of the apparatus main assembly A1 is rotationally supported by being fitted around a coupling shaft 80, which is coaxial with the photosensitive drum 1, and to which a guiding member 81 is fixed so that it does not move relative to the coupling shaft 80 in terms of the axial direction of the coupling shaft 80. This guiding member 81 is slidable inward or outward of the aforementioned CRG catching member 55 in the longitudinal direction of CRG catching member 55 along the internal surface 55*a* of the CRG catching member 55 by an unillustrated mechanical means to establish the mechanical connection between the process cartridge B to drive the process cartridge B (state illustrated in FIG. 17(*b*)) or to break the same mechanical connection (FIG. 17(*a*)). The drum coupling 52 is fixed to the outward end portion of the coupling shaft 80, being prevented from moving in both the rotational direction and axial direction relative to the coupling shaft 80. Referring to FIGS. 17(*a*) and 18(*a*), the drum coupling 52 is provided with six driving force transmission pawls 52*b* (projections), which are on the surface 52*c* which faces the drum coupling 19, and are circularly and evenly distributed around the axial line O of the photosensitive drum 1. The surface 52*b*1 of the drum driving coupling 52, which transmits the driving force to the surface 19*b*1 of the drum coupling 19, extends in the radial direction of the theoretical circle, the center of which coincides with the axial line O of the photosensitive drum 1. The outward portion 80*a* (projection) of the coupling shaft 80 projects from the surface 52*c* of the drum driving coupling 52, and the height of the end surface 80*a*1 of the projection 80*a* from the surface 52*c* is substantially the same as the height of the end surface 52*b*1 of each driving force transmission pawl 52*b* from the surface 52*c*. The end portion 80*a* fits into the engagement hole 19*a* of the drum coupling 19 of the process cartridge B.

The drum driving coupling 52 of the apparatus main assembly A1 moves in the axial direction of the photosensitive drum 1, after the process cartridge B is inserted into the apparatus main assembly A1, more specifically, after the aforementioned cylindrical positioning boss 14*a* (13*a*) is caught by the CRG catching member 55 (state illustrated in FIG. 17(*a*)). Then, at the same time as the end portion 80*a* of the coupling shaft 80 enters the engagement hole 19*a* of the drum coupling 19 of the process cartridge B, the driving force transmission pawls 52*b* lock into the engagement holes 19*b* of the drum coupling 19.

Since the drum driving coupling 52 is prevented from moving in its radial direction by the internal surface 55*a* of the CRG catching member 55, it smoothly rotates during the above described connecting process. Further, the end portion 80*a* of the coupling shaft 80 fits into the engagement hole 19*a* of the drum coupling 19, preventing the precession of the drum coupling 19. As a result, the photosensitive drum 1 is prevented from shaking or wobbling. As the driving force transmission pawls 52*b* lock into the engagement holes 19*a* of the drum coupling 19, it becomes possible for the rotationally driving force to be transmitted from the drum driving coupling 52 to the drum coupling 19.

As described above, in the case of the process cartridge B in this embodiment, the rotation axis of the drum coupling 19 is accurately positioned by the end portion 80*a* of the coupling shaft 80 which projects from the surface 52*a* of the drum driving coupling 52. Therefore, the drum coupling 19 does not undergo precession. Thus, the rotationally driving force is transmitted from the drum driving coupling 52 to the drum coupling 19 while maintaining a stable angular velocity. As a result, the photosensitive drum 1 is prevented from shaking or wobbling during an image forming operation.

Therefore, the aforementioned color aberration, in particular. the color aberration which is caused by the shaking or wobbling of the photosensitive drum 1, is prevented, making it possible to output images with no defect even when a color image forming apparatus A is used.

As for the material for both the drum coupling 19 and drum driving coupling 52, material with a high level of Young s modulus, for example, metallic material such as aluminum, resin in which glass fiber is mixed (reinforced plastic), or the like, may be used. With the use of this type of material, it is possible to reduce the amount of delay in angular velocity transmission which occurs because the drum coupling 19 and drum driving coupling 52 are twisted during the transmission of the rotationally driving force. Therefore, the rotationally driving force can be reliably transmitted in terms of angular velocity.

EMBODIMENT

This embodiment is the same as the one described above except for the materials.

Miscellaneous Embodiments

The preceding embodiments were described with reference to the process cartridge B compatible with a full-color image forming apparatus. However, the present invention is also applicable, with favorable results, to process cartridges for monochromatic, dichromatic, and trichromatic image forming apparatuses.

As for an electrophotographic photosensitive member, it does not need to be limited to the photosensitive drum described above. For example, as for the photosensitive material, in addition to the above described photoconductive material, amorphous silicon, amorphous selenium, zinc oxide, titanium oxide, organic photoconductor other than the above described one, or the like, may be included. As for the shape of the base member on which the photosensitive material is borne, a base member in the form of a belt may be used in addition to the aforementioned base member in the form of a drum. In the case of the drum type photosensitive member, for example, photoconductive material is deposited or coated on the peripheral surface of a cylinder formed of aluminum alloy or the like.

In the preceding embodiments, the charging apparatus was configured to employ the so-called contact type charging method. However, it is obvious that a charging apparatus may be configured to employ a conventional charging method, according to which a piece of tungsten wire is surrounded, on three sides, with a metallic shield formed of aluminum or the like, and the peripheral surface of a photosensitive drum is uniformly charged by transferring positive or negative ions, which are generated by applying high voltage to the tungsten wire, to the peripheral surface of the photosensitive drum.

The configuration of the charging member of a charging apparatus may be in the form of a blade (charge blade), a pad, a block, a rod, a piece of wire, or the like, in addition to the aforementioned roller.

The cleaning method for cleaning the toner which remains on the photosensitive drum 1 may employ a cleaning means which comprises a blade, a fur brush, a magnetic brush, or the like.

According to the definition of a process cartridge, a process cartridge is such a cartridge that comprises an electrophotographic photosensitive member, and at least one processing means. In other words, it is not mandatory that a process cartridge is configured as described in the preceding embodiments. For example, a process cartridge may be: a cartridge which integrally comprises an electrophotographic photosensitive member and a charging means, and is removably installable in the main assembly of an image forming apparatus; a cartridge which integrally comprises an electrophotographic photosensitive member and a cleaning means, and is removably installable in the main assembly of an image forming apparatus; or the like.

In other words, a process cartridge is a cartridge formed by integrating a charging means and/or a cleaning means, and an electrophotographic photosensitive member, into the form of a cartridge which is removably installable in the main assembly of an image forming apparatus. This process cartridge can be installed into, or removed from, the main assembly of an image forming apparatus by a user without assistance, making it possible for the routine maintenance of an image forming apparatus to be carried out independently by a user.

Further, in the preceding embodiments of the present invention, the electrophotographic image forming apparatus was in the form of a laser beam printer. However, the application of the present invention is not limited to a laser beam printer. For example, the present invention is applicable to such an electrophotographic image forming apparatus as an electrophotographic copying machine, a facsimile machine, a word processor, or the like, which is obvious.

According to the present invention, when the process cartridge is mounted to the main assembly of an electrophotographic image forming apparatus, at lease three receptor portions of each of the first positioning portion and the second positioning portion are abutted to the first positioning member of the main assembly, and are abutted to the second positioning member of the mounting means. Therefore, the first and second positioning portions are supported at correct positions by the first positioning member of the main assembly and by the second positioning portion of the mounting means at least at three positions. Thus, the electrophotographic photosensitive member can be correctly positioned in the main assembly of the image forming apparatus.

As described in the foregoing, the present invention provides a process cartridge and an image forming apparatus wherein the electrophotographic photosensitive member can be placed at the correct position.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, the apparatus including a drawer which is movable between an inside position in which the drawer is in the main assembly of the apparatus and an outside position in which the drawer is projected out of the main assembly and said process cartridge is mountable thereto and demountable therefrom, said process cartridge comprising:

an electrophotographic photosensitive member;

process means actable on said electrophotographic photosensitive member; and a frame for supporting at least said electrophotographic photosensitive member;

wherein said frame includes a first positioning portion and a second positioning portion for positioning said process cartridge relative to the main assembly of said electrophotographic image forming apparatus coaxially with said electrophotographic photosensitive member;

wherein said first and second positioning portions are provided adjacent respective ends, in an axial direction of said photosensitive drum; and wherein when said drawer is positioned at the inside position with said process cartridge mounted to said drawer, said first positioning portion is positioned at a mounting position in the main assembly by a first positioning member provided in the main assembly and a second positioning member provided in the drawer, and said second positioning portion is positioned at the mounting position by the first positioning member provided in the main assembly and the second positioning member provided in the drawer, by which said process cartridge is positioned to the mounting position.

2. A process cartridge according to claim 1, wherein said first and second positioning portions are each provided on an outer surface with at least three portions to be positioned; and wherein at least one of said portions to be positioned of said first positioning portion and said second positioning portion is disposed on a line of force along which developing means or transferring means applies force externally to said electrophotographic photosensitive member.

3. A process cartridge according to claim 1 or 2, wherein two of the portions to be positioned of said first positioning portion and second positioning portion are abutted to said first positioning member of the main assembly of said electrophotographic image forming apparatus, and one of each of the portions to be positioned of said first positioning portion and said second positioning portion is abutted to a second positioning member of the drawer.

4. A process cartridge according to claim 1 or 2, wherein said first and second positioning portions are provided on one and the other end, in a longitudinal direction of said frame, of surfaces of said frame, and projected outwardly, coaxially with said electrophotographic photosensitive member.

5. A process cartridge according to claim 3, wherein said portions to be positioned are in the form of a projection extending from an outer surface of said frame.

6. A process cartridge according to claim 1 or 2, wherein said process means includes at least charging means for electrically charging said electrophotographic photosensitive member, and cleaning means for removing developer remaining on said electrophotographic photosensitive member.

7. An electrophotographic image forming apparatus for forming an image on a recording material, wherein a process cartridge is a detachably mountable to a main assembly of said electrophotographic image forming apparatus, comprising:

(a) a drawer which is movable between an inside position in which the drawer is in the main assembly of the apparatus and an outside position in which said drawer is projected out of the main assembly and said process cartridge is mountable thereto and demountable therefrom;

(b) a first positioning member provided in said main assembly;

(c) a second positioning member provided in said drawer;

(d) a mounting portion for detachably mounting said process cartridge, said process cartridge including:

an electrophotographic photosensitive member;

process means actable on said electrophotographic photosensitive member; and a frame for supporting at least said electrophotographic photosensitive member;

wherein said frame includes a first positioning portion and a second positioning portion for positioning said process cartridge relative to the main assembly of said electrophotographic image forming apparatus coaxially with said electrophotographic photosensitive member;

wherein said first and second positioning portions are provided adjacent respective ends, in an axial direction of said photosensitive drum;

wherein when said drawer is positioned at the inside position with said process cartridge mounted to said drawer, said first positioning portion is positioned at a mounting position in the main assembly by said first positioning member provided in the main assembly and said second positioning member provided in the drawer, and said second positioning portion is positioned at the mounting position by said first positioning member and said second positioning member, by which said process cartridge is positioned to the mounting position; and e) feeding means for feeding the recording material.

* * * * *

UNITED STATES PATENT AND TRADEMARK OFFICE

CERTIFICATE OF CORRECTION

PATENT NO. : 6,282,390 B1 
DATED : August 28, 2001
INVENTOR(S) : Shigeo Miyabe et al.

It is certified that error appears in the above-identified patent and that said Letters Patent is hereby corrected as shown below:

Title page,
Item [57], ABSTRACT,
Line 3, “includes” should read -- includes: --.

Item [56], References Cited, U.S. PATENT DOCUMENTS, “Miatsuzaki et al.” should read -- Matsuzaki et al. --.

Column 1,
Line 15, “examples,” should read -- example, --.

Column 2,
Line 7, “wherein” should read -- and wherein --.
Line 56, “FIG. 16 is a perspective view” should read -- FIGS. 16(a) and 16(b) are perspective views --.
Line 58, “FIG. 17 is a horizontal sectional view” should read -- FIGS. 17(a) and 17(b) are horizontal sectional views --.
Line 65, close up right margin.

Column 3,
Line 13, “means” should read -- refers to --.
Line 18, “means” should read -- refers to --.
Line 33, “a drum” should read -- a drum. --.
Line 51, “drum 1” should read -- drum 1. --.
Line 54, “drum 1” should read -- drum 1. --.
Line 58, “apparatus,” should read -- apparatus 2, --.
Line 62, “apparatus main assembly)” should read -- “apparatus main assembly”) --.

Column 4,
Line 48, “rotary 4A,” should read -- rotary device 4A, --.
Line 65, “device” should read -- device which --.

Column 5,
Line 1, “roller 4d” should read -- roller 4a --.

Column 6,
Line 20, “one” should read -- one. --; and “FIG. 3.” should read -- FIG. 3, --.
Line 31, “the” should read -- The --.
Line 55, “medium S” should read -- medium S. --.
Line 66, “is” should read -- are --.

UNITED STATES PATENT AND TRADEMARK OFFICE

CERTIFICATE OF CORRECTION

PATENT NO. : 6,282,390 B1
DATED : August 28, 2001
INVENTOR(S) : Shigeo Miyabe et al.

It is certified that error appears in the above-identified patent and that said Letters Patent is hereby corrected as shown below:

Column 7,
Line 18, “medium 2” should read -- medium S --.

Column 8,
Line 14, “provided” should read -- provided. --.

Column 9,
Line 67, “shutter 1,” should read -- shutter 18, --.

Column 10,
Line 10, “detail” should read -- detail. --.
Line 14, “14” should read -- 14a --.
Line 17, “axial.” should read -- axial --.

Column 11,
Line 6, “butting portion 5d” should read -- abutting portion 50d --.
Line 10, “butting” should read -- abutting --.
Line 26, “action 13” should read -- action l3 --.
Line 43, “butting” should read -- abutting --.

Column 12,
Line 2, “action 12” should read -- action l2 --.
Line 9, “requirement” should read -- requirement. --.
Line 11, “portion 14a4” should read -- portion 14a3 --.
Line 12, “(13a4),” should read -- (13a3), --.
Line 13, “portion 14a3 (13a3)” should read -- portion 14a4 (13a4) --.
Line 27, “413k” should read -- 4Bk --.
Line 33, “detect” should read -- defect --.
Line 35, “Intermediary” should read -- intermediary --.

Column 13,
Line 12, “shaft 1a1” should read -- shaft 1a1. --.
Line 16, “D-cup” should read -- D-cut --.

Column 16,
Line 48, “provided” should read -- provided at --.

UNITED STATES PATENT AND TRADEMARK OFFICE

CERTIFICATE OF CORRECTION

PATENT NO. : 6,282,390 B1
DATED : August 28, 2001
INVENTOR(S) : Shigeo Miyabe et al.

It is certified that error appears in the above-identified patent and that said Letters Patent is hereby corrected as shown below:

Column 17,
Line 6, "and" should read -- and said --.

Signed and Sealed this

Nineteenth Day of November, 2002

*Attest:*

*Attesting Officer*

JAMES E. ROGAN
*Director of the United States Patent and Trademark Office*